US006363636B1

(12) United States Patent
Hess et al.

(10) Patent No.: US 6,363,636 B1
(45) Date of Patent: Apr. 2, 2002

(54) FLAME SIMULATING ASSEMBLY AND COMPONENTS THEREFOR

(75) Inventors: Kristoffer Hess, Cambridge; David Miller MacPherson, Paris; Ignazio Gallo, Cambridge; Sean David Spencer, Chatsworth, all of (CA)

(73) Assignee: Dimplex North America Limited, Cambridge (CA)

( * ) Notice: Subject to any disclaimer, the term of this patent is extended or adjusted under 35 U.S.C. 154(b) by 0 days.

(21) Appl. No.: 09/443,324

(22) Filed: Nov. 19, 1999

Related U.S. Application Data

(60) Division of application No. 08/868,948, filed on Jun. 4, 1997, now Pat. No. 6,050,011, which is a continuation-in-part of application No. 08/649,510, filed on May 17, 1996, now Pat. No. 5,642,580.

(51) Int. Cl.[7] ..... G09F 19/00
(52) U.S. Cl. ..... 40/428
(58) Field of Search ..... 40/428; 362/92, 362/96, 253, 806; 392/348; 472/65

(56) References Cited

U.S. PATENT DOCUMENTS

| | | | | | |
|---|---|---|---|---|---|
| 2,285,535 | A | * | 6/1942 | Schlett | 40/428 |
| 2,708,114 | A | * | 5/1955 | Hancock | 40/428 |
| 2,963,807 | A | * | 12/1960 | Relph et al. | 40/428 |
| 3,797,934 | A | * | 3/1974 | Miller et al. | 355/52 |
| 4,965,707 | A | * | 10/1990 | Butterfield | 40/428 X |
| 5,195,820 | A | * | 3/1993 | Rehberg | 40/428 X |
| 5,648,827 | A | * | 7/1997 | Shaw | |

FOREIGN PATENT DOCUMENTS

| | | | | |
|---|---|---|---|---|
| GB | 426887 | * | 4/1935 | 40/428 |
| GB | 9502867.6 | * | 2/1995 | |

* cited by examiner

*Primary Examiner*—Brian K. Green

(57) ABSTRACT

An electric fireplace is provided having an improved flame simulating apparatus. In one aspect, the flame simulating apparatus includes a light source, a flame effect element for reflecting light to produce a flame effect, and a flicker element having reflective strips for reflecting light from the light source for subsequent reflection by the flame effect element. A screen having a partially reflecting surface and a diffusing member is positioned with the flame effect element extending proximate to the diffusing member. A fuel bed is positioned immediately adjacent to the partially reflecting surface of the screen to produce an image of the fuel bed on the screen with the image of moving flames appearing to emanate between the fuel bed and its reflected image. An alternate screen is provided having a non-planar diffusing member which causes the image of moving flames to appear to emanate from behind the reflected image the fuel bed. A fire wall simulating apparatus is also provided to provide a reflection of a simulated fire wall on the partially reflecting surface which appears to be a fire wall behind the fuel bed.

21 Claims, 21 Drawing Sheets

FLAME SIMULATING ASSEMBLY AND COMPONENTS THEREFOR

FIELD OF THE INVENTION

This is a divisional application of application Ser. No. 08/868,948, filed Jun. 4, 1997, now U.S. Pat. No. 6,050,011, which was a continuation-in-part application of prior application Ser. No. 08/649,510, filed May 17, 1996, now U.S. Pat. No. 5,642,580.

The present invention relates generally to simulated fireplaces and, more particularly, to flame simulating assemblies for electric fireplaces and the like.

BACKGROUND OF THE INVENTION

Electric fireplaces are popular because they provide the visual qualities of real fireplaces without the costs and complications associated with venting of the combustion gases. An assembly for producing a realistic simulated flame for electric fireplaces is disclosed in U.S. Pat. No. 4,965,707 (Butterfield). The Butterfield assembly uses a system of billowing ribbons and a diffusion screen for simulating flames. The simulated flames are surprisingly realistic, although the effect resembles a flame from a coal fuel source (which is popular in Europe), rather than a log fuel source (which is more popular in North America). The flames for burning logs tend to be more active and extend higher above the fuel source. Also the log flame tends to be less red (and more yellow) in color than the coal flame.

There is a need for an assembly for producing a simulated flame that more realistically resembles the flame from a burning log. Also, there is a need to improve the light intensity of the simulated flame to more realistically resemble the intensity of real flames.

SUMMARY OF THE INVENTION

The present invention is directed to an improved flame simulating assembly that produces a realistic appearing flame.

In one aspect, the invention provides a screen, for use in a flame simulating assembly, comprising:

a partially translucent diffusing element sized to extend substantially across the area where a flame effect is desired, said partially translucent diffusing element having a thickness adapted to diffuse light through said thickness; and;

a partially reflecting element sized to substantially oppose sad diffusing element, said reflecting element having a partially reflecting surface which faces away from said diffusing element;

wherein light passing through said diffusing element is visible through said partially reflecting surface.

In a second aspect, the invention provides a screen, for use in a flame simulating assembly, comprising:

a translucent diffusing element sized to extend substantially across the area where a flame effect is desired, said diffusing element being substantially non=planar; and;

a partially reflecting element sized to substantially oppose said diffusing element, said reflecting element having a partially reflecting surface which faces away from said diffusing element;

wherein light passing through said diffusing element is visible through said partially reflecting surface.

In a third aspect, the invention provides a flame simulating assembly comprising:

a light source;

at least one flicker element having at least one reflective surface;

a flame effect element formed of a piece of a substantially reflective material sized to extend substantially fully across the area of where a flame effect is desired;

a screen having a light diffusing element sized to extend substantially fully across the area of where a flame effect is desired, said flame effect element extending proximate to said light diffusing element, wherein light from said light source is reflected from said flicker element to said flame effect element, and reflected from said flame effect element to said screen; and means for moving said light reflected from said light source to produce an image on said screen which resembles moving flames.

In a fourth aspect, the invention provides a fireplace assembly comprising:

a substantially transparent front wall having an inner surface;

a reflective surface facing said inner surface of said front wall; and a pattern applied to said inner surface of said front wall, said pattern being substantially invisible to an observer looking through said substantially transparent front wall but visible as a reflection in said reflective surface.

In a fifth aspect, the invention provides a flicker element for use in a flame simulating assembly comprising a plurality of reflective strips protruding radially from a rod, said strips being non-rectilinear in shape.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
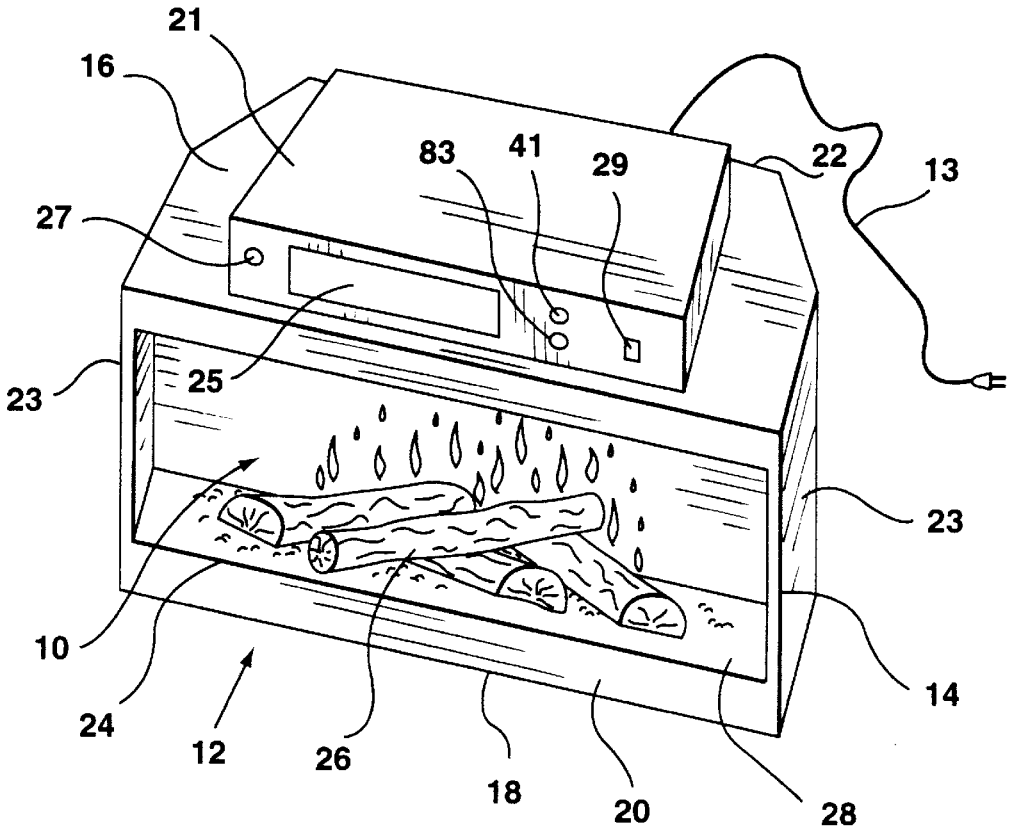
FIG. 1 is a perspective view of an electric fireplace incorporating a flame simulating assembly in accordance with the present invention.

A flame simulating assembly in accordance with the present invention is shown generally at 10 in the figures. The assembly is incorporated within an electric fireplace which is depicted generally at 12 with an electrical connection 13 for connecting to a power source (not shown).

The electric fireplace 12 includes a housing 14 that defines a simulated firebox having top, bottom, front, rear and side walls 16, 18, 20, 22 and 23, respectively. A portion of the front wall is defined by a transparent front panel 24 that is removable to permit access to the contents of the housing 14. A control unit 21 is located above the top wall of the housing. The control unit 21 includes a heater unit 25, a thermostat 27 for controlling the heat output and a main power switch 29 for actuating the flame effect.

Figure 2:
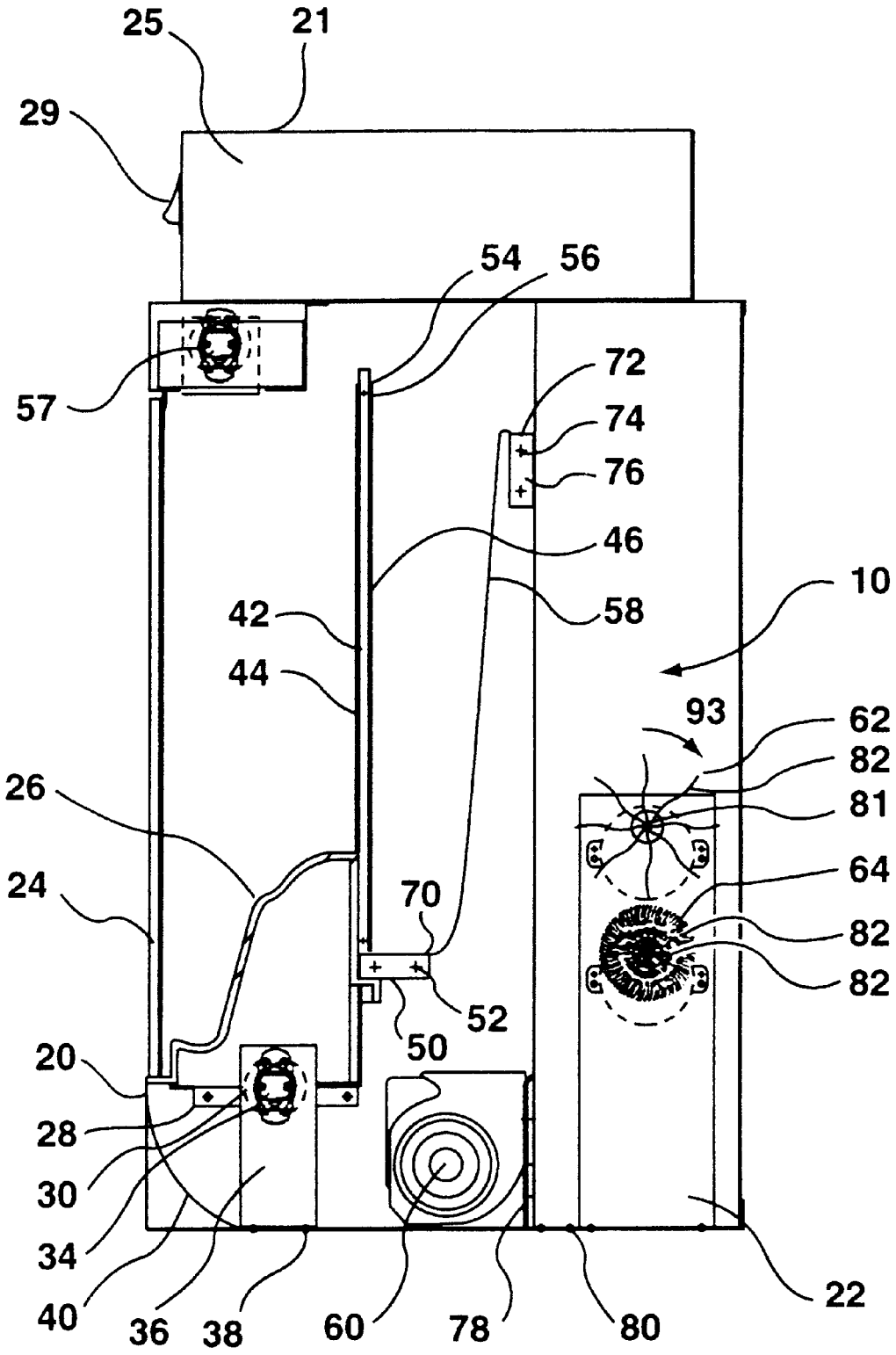
FIG. 2 is a side view of the assembly of FIG. 1 showing elements behind the side wall.
Figure 3:
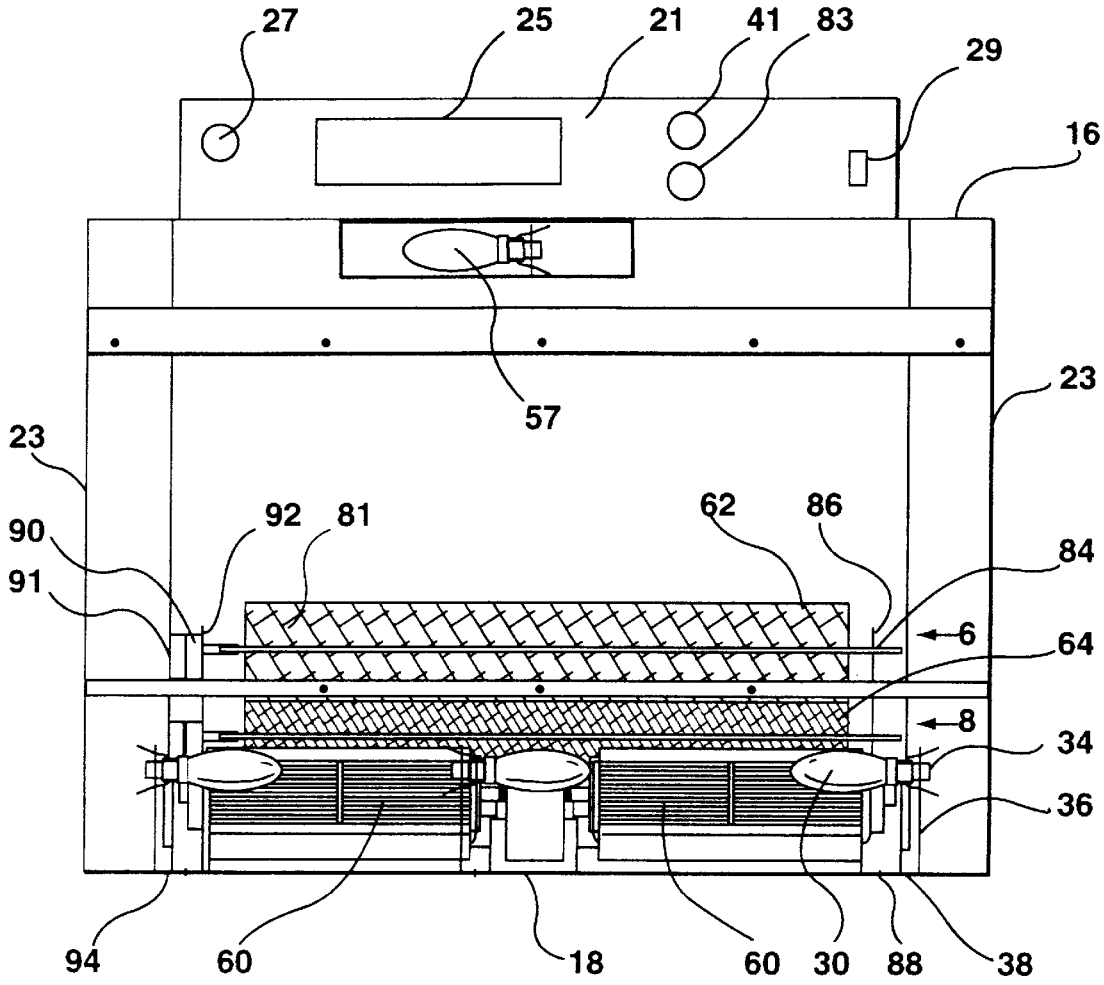
FIG. 3 is a front view of the assembly of FIG. 1 showing elements below the top wall.
Figure 4:
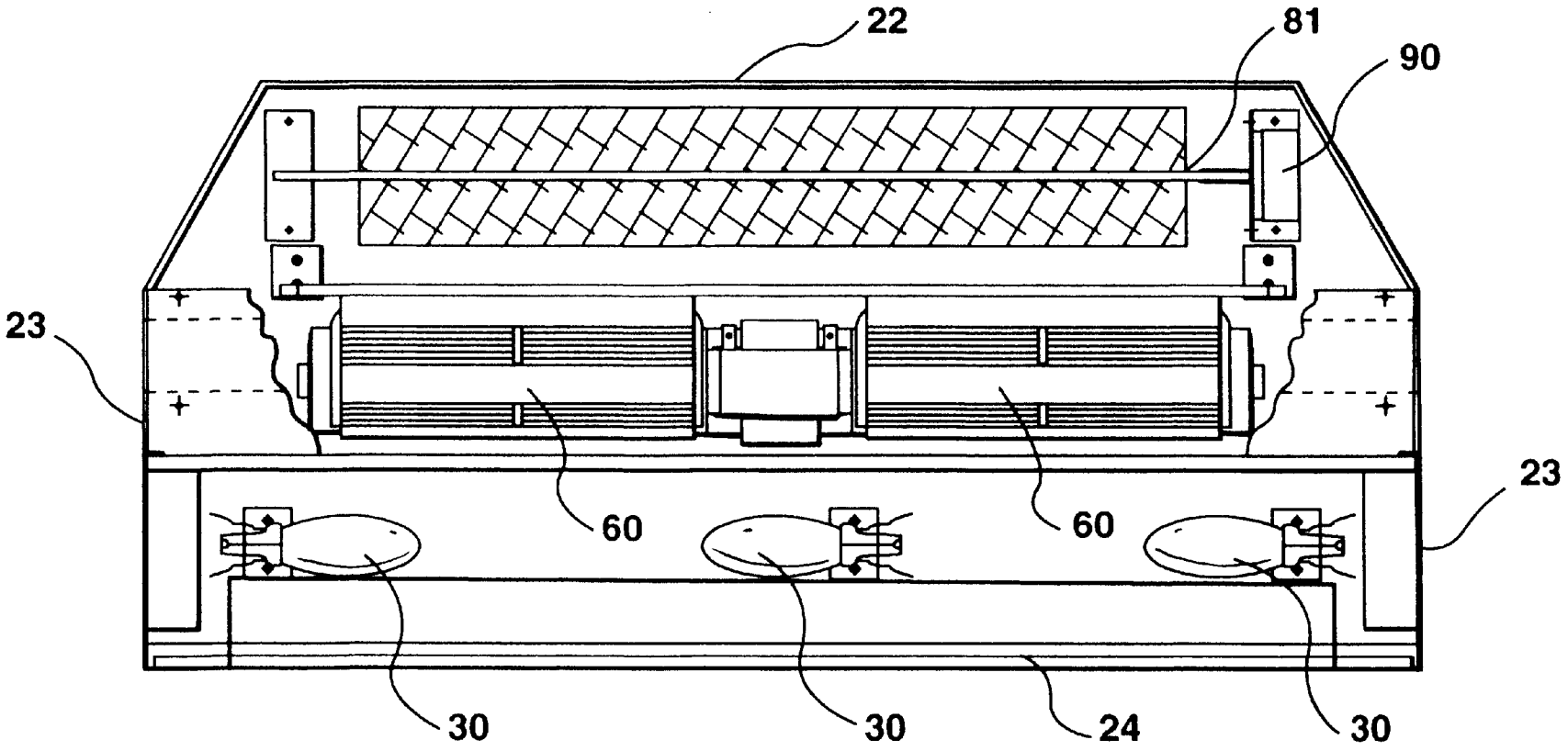
FIG. 4 is a top view of the assembly of FIG. 1 showing elements behind the front wall.

Referring to FIG. 2, a simulated fuel bed 26 is supported on a platform 28 located at a lower front portion of the housing 14. The fuel bed 26 comprises a plastic shell that is vacuum formed and colored to resemble logs and embers for a log burning fire.

Portions of the shell are translucent to permit light from a light source 30 located beneath the fuel bed 26 to shine through. For instance, the shell may be formed from an orange translucent plastic. The top side of the plastic shell may be painted in places to resemble the surface of logs. The underside of the plastic shell may be painted black (or some other opaque color) and then sanded in portions where it is desired for light to pass. For instance, the protruding points on the underside of the shell (corresponding to indents in the top side) may be sanded to allow light passage. These points would thus resemble the embers of a fire. Also, the crotch area between simulated logs may be sanded (or left unpainted) to resemble embers at the intersection of two logs.

The light source 30 comprises three 60 watt light bulbs that are supported in sockets 34 below the fuel bed 26. Alternatively, one or more quartz halogen lights may be utilized. The sockets 34 are supported by vertical arms 36 that are connected with fasteners 38 to the bottom wall of the housing 14. A parabolic reflector 40 is located below the light source 30 at the lower front end of the housing 14 to direct light toward the rear of the housing 14. The intensity of the light can be varied with a dimmer switch 41 that is electrically connected to the light source 30 and located on the control unit 21.

Figure 9:
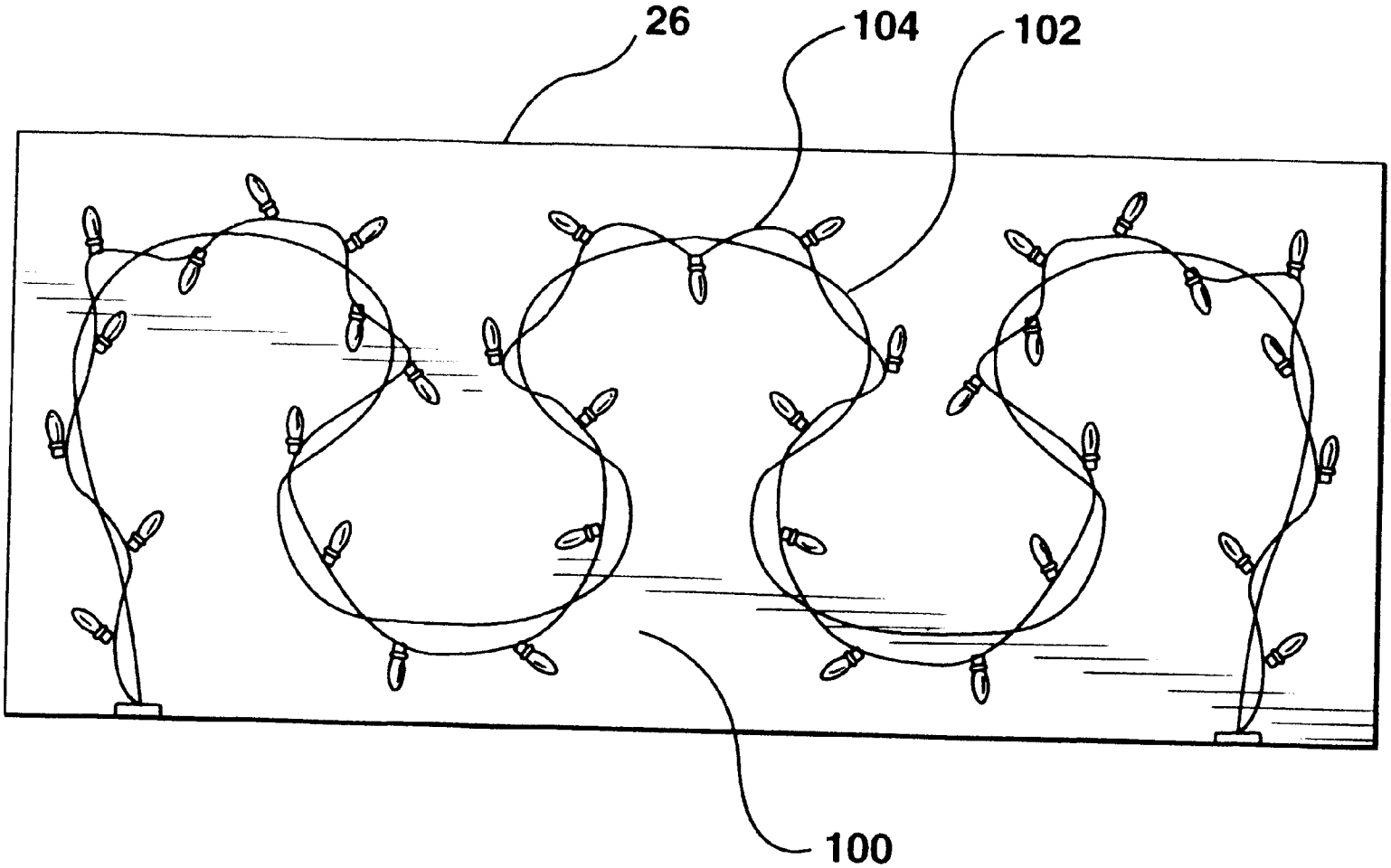
FIG. 9 is a top view of a fuel bed light assembly for the assembly of FIG. 1 in accordance with a further embodiment of the present invention.

In a further embodiment of the invention as shown in FIG. 9, a fuel bed light assembly 100 may be arranged beneath the underside of the fuel bed 26. The fuel bed light assembly 100 includes a support element 102 that supports a string of lights 104 beneath the fuel bed 26. The lights 104 are adapted to flicker at different times to give the impression of increases and decreases in heat (as depicted by differences of light intensity) in the embers of the fuel bed. It has been found that conventional Christmas lights are suitable for this purpose. It has also been found that a realistic ember effect may be generated by positioning four regular light bulbs beneath the bed and randomly varying the intensity of the lights using a micro-processor (not shown).

Located immediately behind the fuel bed 26 is a vertical screen 42. The screen 42 is transparent and has a partially reflecting surface 44 and a diffusing surface 46. The screen 42 is seated in a groove 48 defined in a lower horizontal support member 50. The lower horizontal support member 50 is fastened to the side walls 23 of the housing 14 with fasteners 52. The screen 42 is supported on its sides with side frame members 54 that are fastened to the side walls 23 with fasteners 56. The screen structure is described in more detail in U.S. Pat. No. 4,965,707 which is incorporated herein by reference.

The screen 42 is positioned immediately behind the fuel bed 26 so that the fuel bed 26 will be reflected in the reflecting surface 44 to give the illusion of depth. As will be explained further below, the image of simulated flames appears to be emanating from between the fuel bed 26 and the reflection of the fuel bed 26 in the screen. Also, simulated flames appear to be emanating from the reflected image of the fuel bed 26. An upper light source 57 is located at the top front portion of the housing for illuminating the top of the simulated fuel bed 26 and enhancing the reflected image in the screen 42.

Referring more closely to the flame simulation assembly 10, the assembly includes a flame effect element 58, a blower 60 and upper and lower flicker elements 62 and 64.

Figure 5:
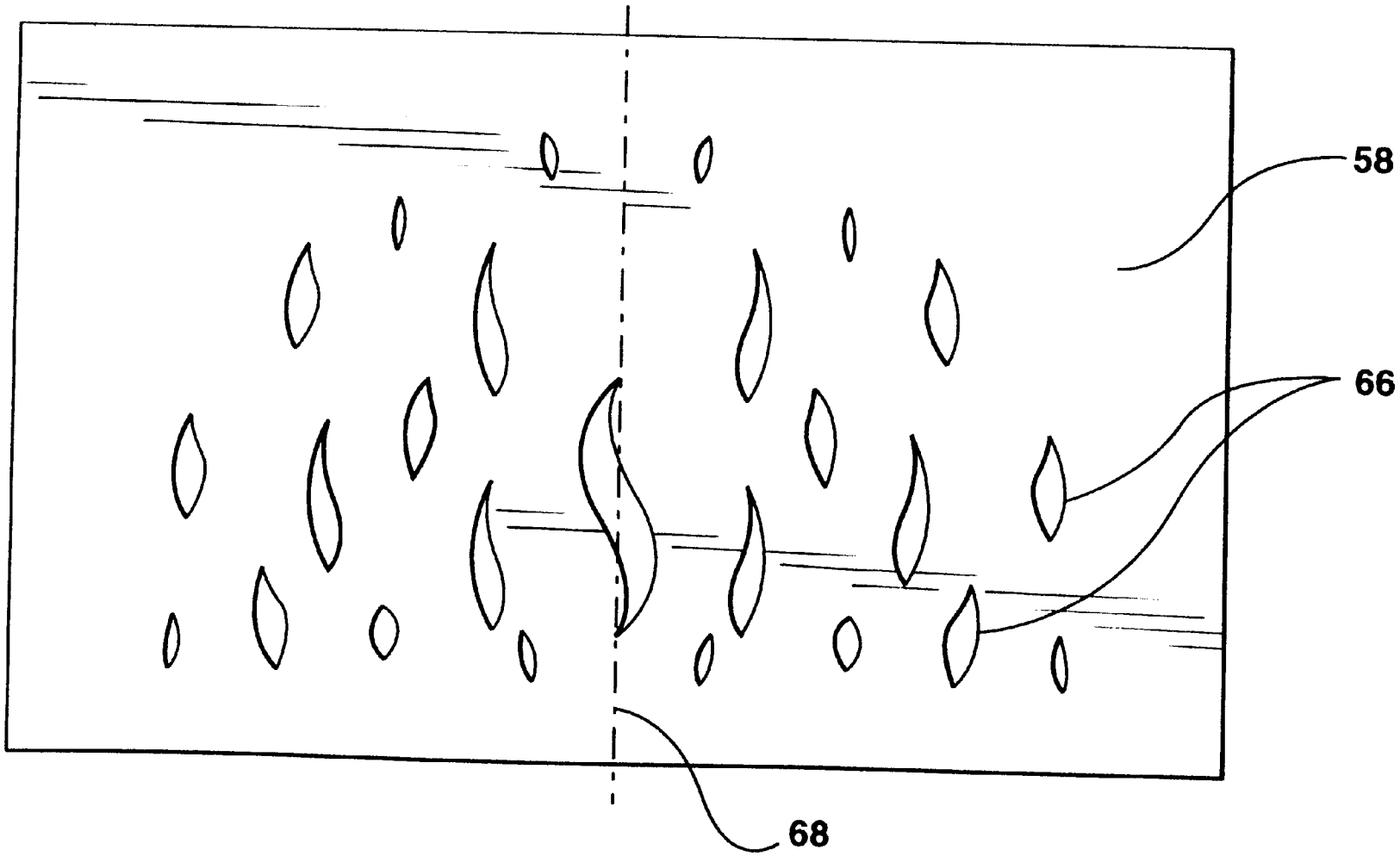
FIG. 5 is a front view of a flame effect element for the assembly of FIG. 1.

As shown in FIG. 5, the flame effect element 58 is formed from a single thin sheet of a light-weight, substantially opaque, material such as polyester. The element 58 extends across substantially the full width of the screen 42. A plurality of slits 66 are cut into the flame effect element 58 to permit passage of light through the flame effect element 58 as it billows under the influence of air currents from the blower 60. Longer sized slits 66 are located at the lower end of the flame effect element 58 to simulate longer flames emanating from the fuel bed 26. Smaller slits 66 are located at the upper end of the flame effect element 58 to simulate the licks of flames that appear above the large main flames emanating from the fuel bed 26. The slits 66 are arranged in a pattern that is symmetrical about a center axis 68 of the flame effect element 58 to give a balanced appearance to the flame effect. The element 58 may be coated with plastic film (such as polyurethane) to retard fraying about the edges of the slits. Alternatively, the flame effect element could comprise a plurality of discrete flame effect elements 58 as disclosed in U.S. Pat. No. 5,965,707 that is incorporated herein by reference.

The flame effect element 58 is supported at its bottom end by fasteners 70 that connect to the lower horizontal support member 50. The flame effect element 58 is supported at its upper end by fasteners 72 that connect to an upper horizontal support member 74. The upper horizontal support member is connected by fasteners 76 to the side walls of the housing 14.

The flame effect element 58 is supported relatively loosely between the horizontal supports so that it will billow or ripple with the air currents from the blower 60. The blower 60 is supported by a mounting bracket 78 that is supported with fasteners 80 to the bottom wall of the housing 14. An airflow control switch 83 is provided on the control unit 21 to vary the blower airflow to a desired amount. The greater the airflow, the more active the flame will appear. Alternatively, the flame effect element 58 may be moved mechanically to produce sufficient billowing or rippling to give the flame effect.

In use, light is transmitted from the light source 30 through the slits 66 of the flame effect element 58 to the diffusing surface 46 of the screen 42. The flame effect element 58 billows in the airflow from the blower 60 to vary the position and size of the slits 66. The resulting effect is for the transmitted light to resemble flames licking from a fire. As will be explained further below, the transmitted light is at least partially colored due to its reflecting from a colored reflecting surface 82 of a flicker element 62, 64 prior to passing through the slits 66.

Figure 6:
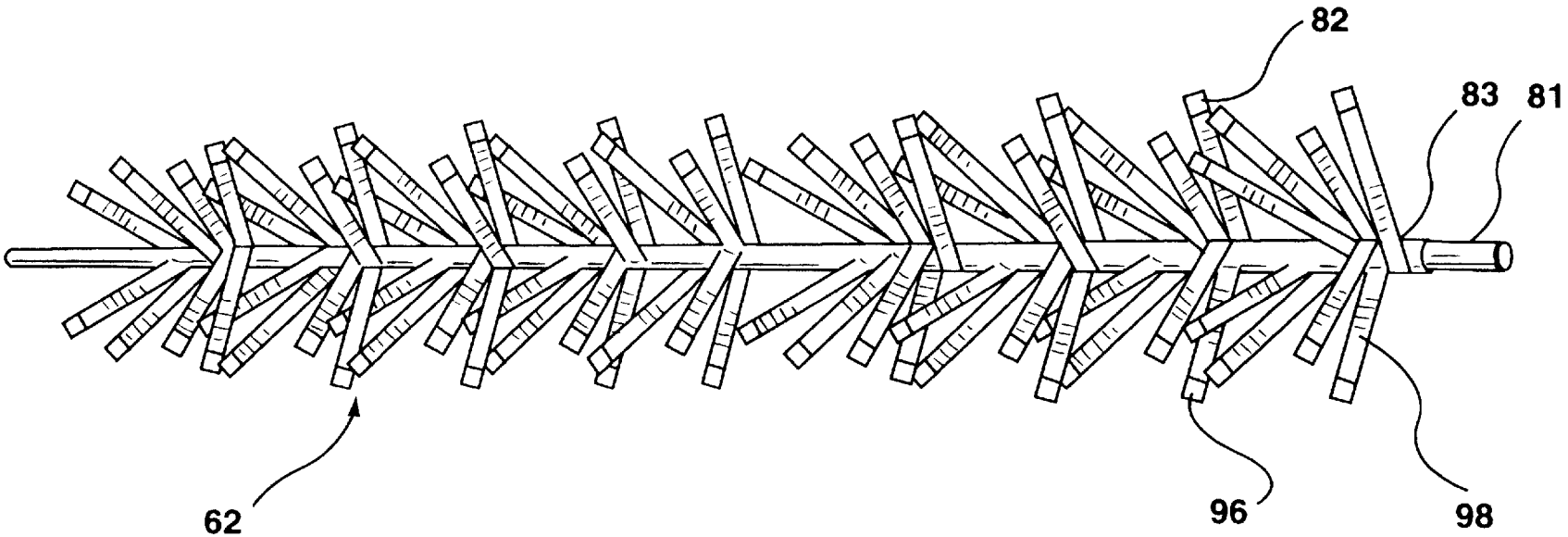
FIG. 6 is a perspective view of the upper flicker element for the assembly of FIG. 1, as viewed along direction arrow 6 in FIG. 3.
Figure 8:
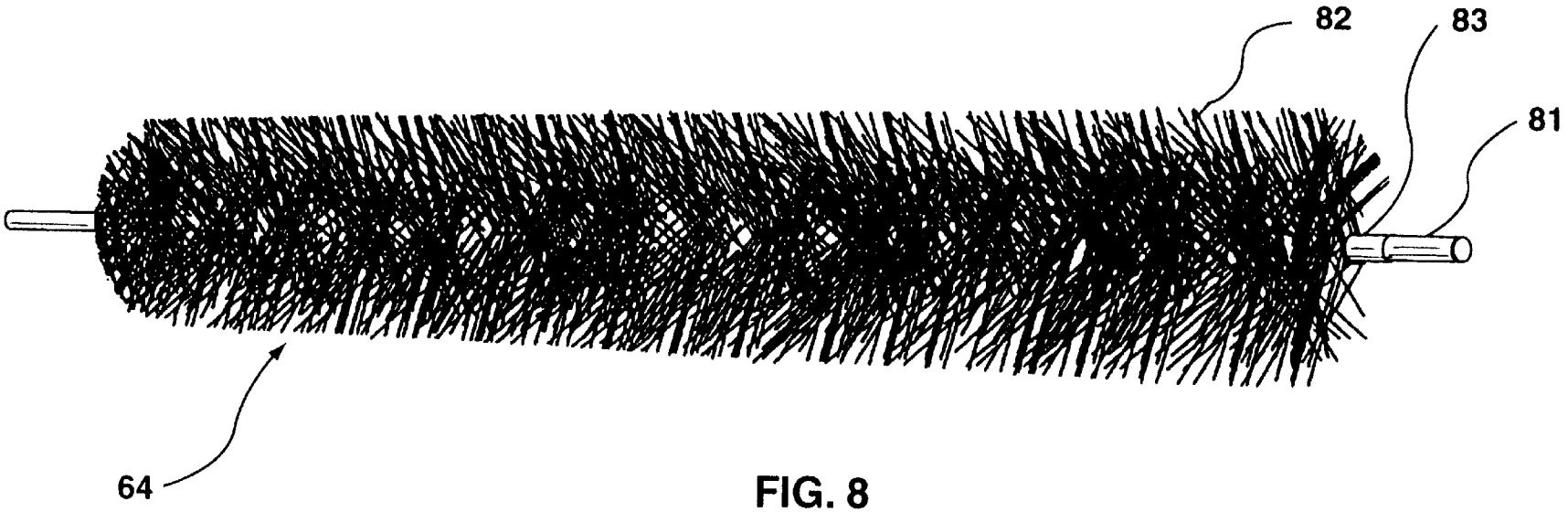
FIG. 8 is a perspective view of the lower flicker element for the assembly of FIG. 1, as viewed along direction arrow 8 in FIG. 3.

The upper and lower flicker elements 62, 64 are located rearwardly from the flame effect element 58 proximate to the rear wall of the housing 14. As shown in FIGS. 6 and 8, each flicker element comprises an elongate rod 81 having a plurality of reflective strips 82 extending radially outwardly therefrom. The flicker elements 62, 64 preferably have a diameter of about two to three inches. The strips 82 are formed from a length of material having a width of approximately one and a half inches. A series of transverse slits are cut along one elongate side of the length of the material 83 to define each individual strip 82. The length of material 83 is then wrapped bout the rod 81 so that the strips 82 protrude radially about the full circumference of the rod 81. Alternatively, the strips 82 may be cut to lengths of around two to three inches and clamped at their centers by spiral wound wires that form the rod 81. Alternatively, the reflective surfaces of the flicker elements could be mirrored glass pieces arranged about the surface of a cylinder.

The rods 81 are supported at one end in corresponding recesses 84 defined in a vertical support arm 86 that is connected by fasteners 88 to the bottom wall of the housing 14. The rods 81 are connected at their other end to corresponding rotors 90 for rotating each rod 81 about its axis. The rotors 90 are rotated by electric motors 91 as shown. The rotors 90 are supported by a vertical support member 92 that is connected with fasteners 94 to the bottom wall of the housing 14. Alternatively, the rotor 90 may be rotated by air currents from the blower 60 engaging corresponding fins on the rotors. Preferably, the rotors 90 rotate the flicker elements 62, 64 in the direction indicated by arrow 93 in FIG. 2 so that an appearance of upward motion is imparted on the reflected light images. This simulates the appearance of upwardly moving gasses from a fire. It is contemplated that other means for simulating the appearance of upwardly moving gasses may be used. For instance, a light source (not shown) may be contained within a moving, partially opaque, screen (not shown) to produce the desired light effect. It is also contemplated that the flicker elements 62, 64 or the above described gas simulating means may be used alone without the flame effect element 58. It has been found that the use of the flicker elements 62, 64 alone produces a realistic effect although not as realistic as when used in combination with the flame effect element 58.

Referring to FIG. 2, it may be seen that the lower flicker element is positioned slightly below the horizontal level of the upper end of the fuel bed 26. This facilitates the appearance of upwardly moving gasses and colored flames emanating from near the surface of the fuel bed when viewed by a person in front of the fireplace. Similarly, the upper flicker element is positioned at a horizontal level above the fuel bed 26 to give the appearance of upwardly moving gasses and colored flames emanating a distance above the fuel bed when viewed by a person in front of the fireplace. In addition, the upper and lower flicker elements 62, 64 improve the light intensity of the simulated flame and gasses.

Figure 7:
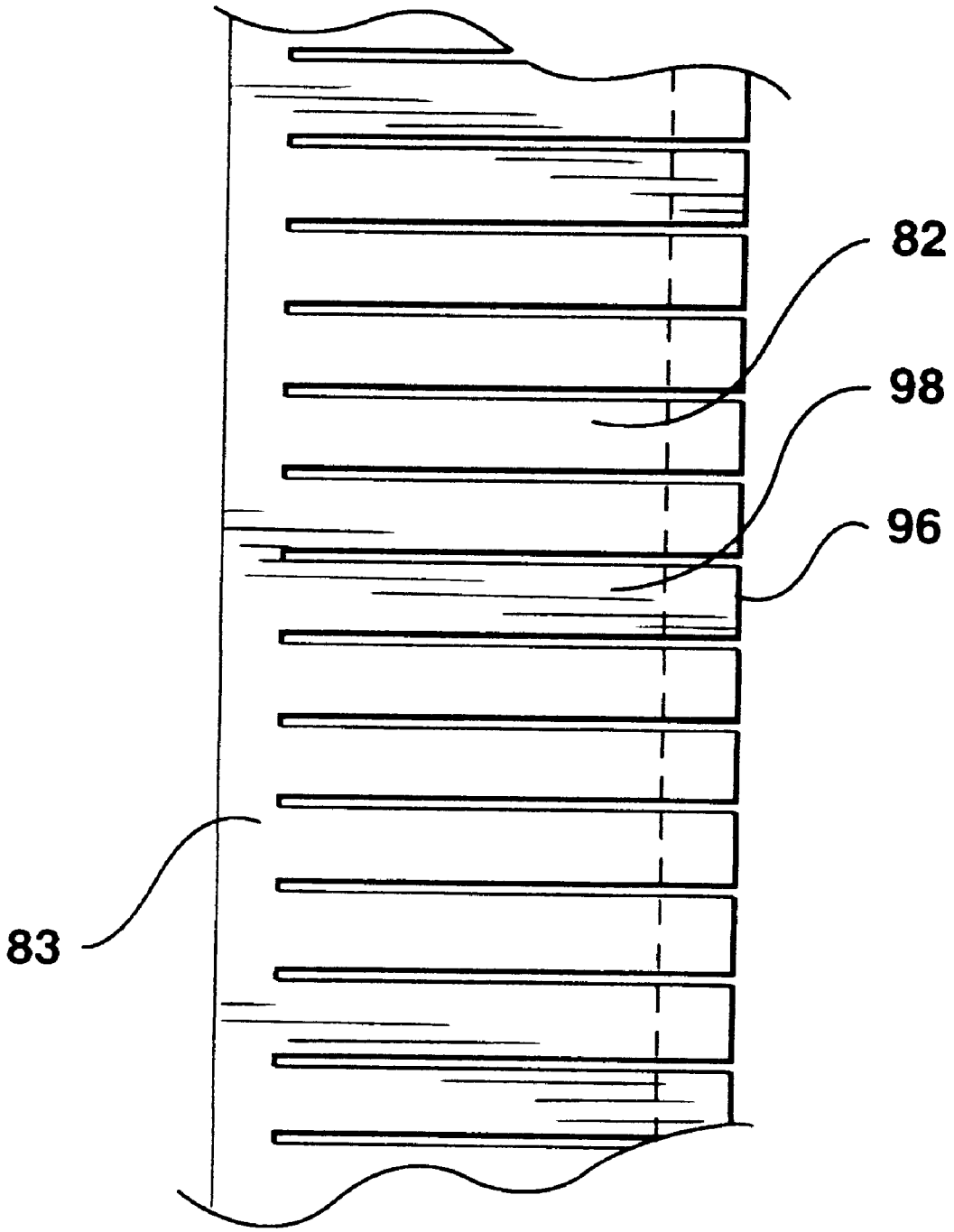
FIG. 7 is a partial plan view of a length of material defining a plurality of radial strips for the upper flicker element of FIG. 1.

Referring more closely to FIG. 7, the strips 82 for the upper flicker element 62 are shown. Each strip 82 is formed from a reflective material such as MYLAR™. The strip 82 is preferably colored with either a blue or red tip 96 and a silver body 98, although a fully silver body has been used successfully as well. A length of material 83 with red tipped strips 82 and a length of material 83 with blue tipped strips 82 may both be wrapped about the rod 81. As shown in FIG. 6, a combination of blue and red tipped strips 82 protrude radially from the rod 81 over the entire length of the flicker element 62. As a result, the upper flicker element 62 reflects white, red and blue light that is subsequently transmitted through the flame effect element 58.

The lower flicker element 64, as shown in FIG. 8, comprises a dense arrangement of thin strips 82 that are formed from a reflective material such as MYLAR™. The strips 82 are either substantially gold in color, or substantially red in color. A combination of lengths of material 83 with red strips 82 and gold strips 82 may be wrapped around the rod 81 to produce an overall red and gold tinsel appearance. As a result, the lower flicker element 64 reflects yellow and red light that is subsequently transmitted through the flame effect element 58.

In use, the flicker elements 62, 64 are rotated by the rotors 90 so that the reflective surfaces of the strips 82 reflect colors through the slits 66 of the billowing flame effect element 58 and produce the effect of upwardly moving gasses. The colors reflected by the lower flicker element 64 resemble the colors of flames located near the surface of the fuel bed 26. The colors reflected by the upper flicker element 62 resemble the colors of flames that are located further from the surface of the fuel bed 26. The upper flicker element 62 has a less dense arrangement of strips 82 in order to produce more random reflections that simulate a more active flickering flame at a distance above the fuel bed 26. The more dense arrangement of strips 82 in the lower flicker 64 produces relatively more constant reflections that simulate the more constant flame activity adjacent to the fuel bed 26.

Figure 10:
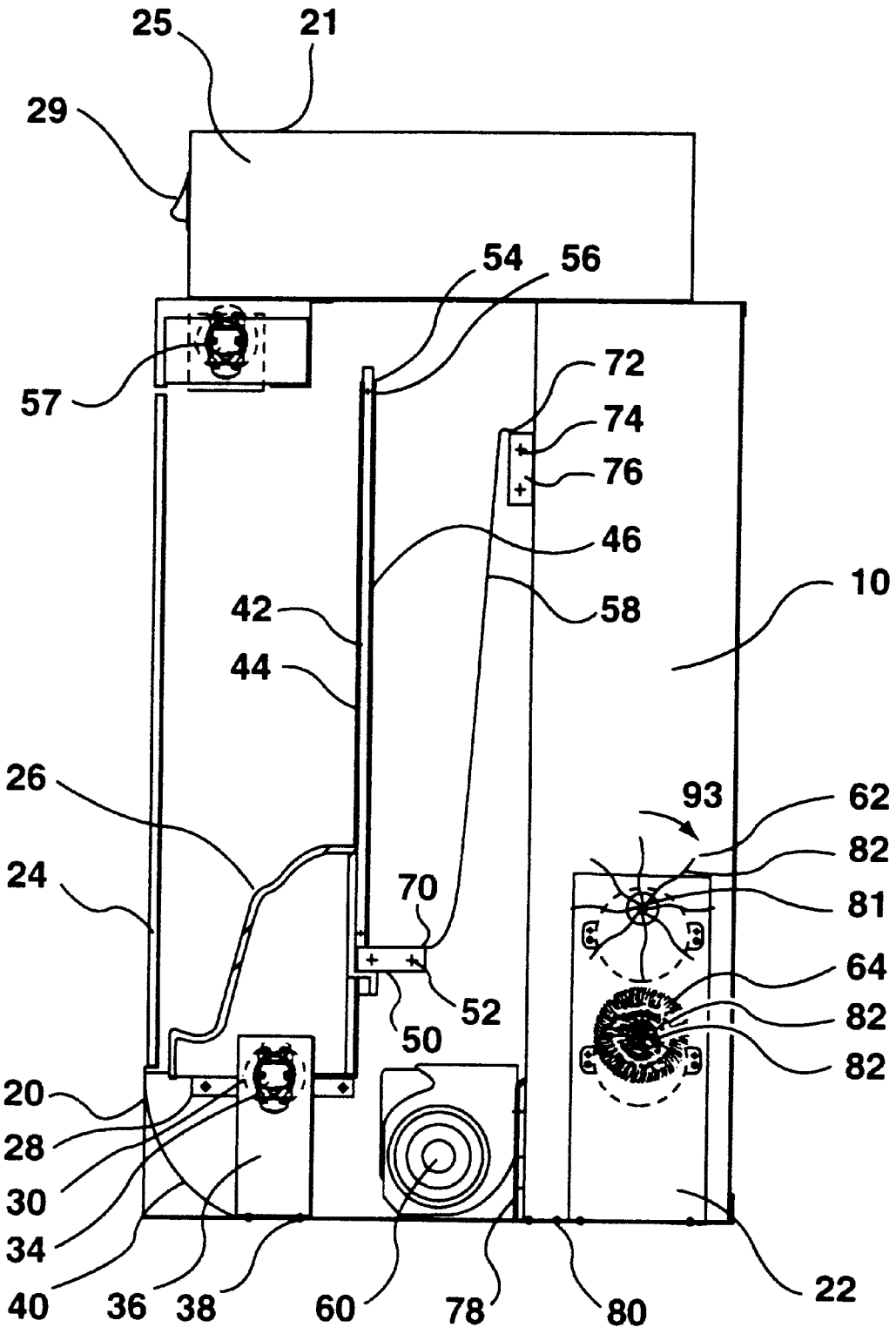
FIG. 10 is a side view of a second embodiment of the flame simulating assembly showing an alternative orientation of the flicker elements.

Referring to FIG. 10, an alternative orientation for the flicker element 62, 64 is shown. The upper flicker element 62 is positioned slightly below the horizontal level of the upper end of the fuel bed 26. The lower flicker element 64 is positioned slightly above the horizontal level of the lower end of the fuel bed 26. The lower flicker element 64 is positioned slightly above the horizontal level of the lower end of the fuel bed 26.

Figure 11:
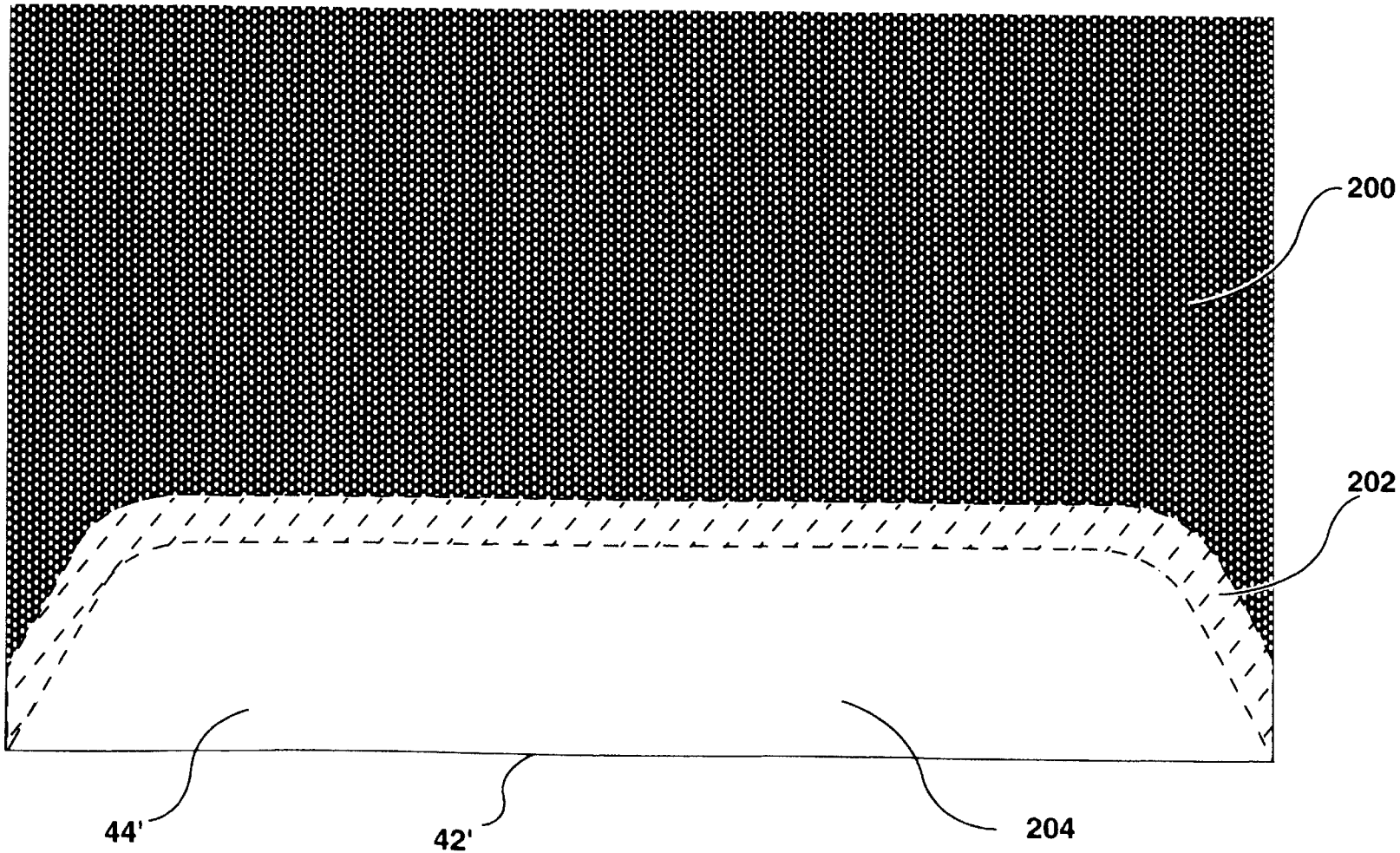
FIG. 11 is a front view of a second embodiment of the vertical screen showing the partially reflecting surface divided into regions.

Referring to FIG. 11, an improved vertical screen 42' is depicted. The front of the screen includes a partially reflecting surface 44' that is divided into a matte region 200, a transition region 202 and a reflecting region 204. The reflecting region 204 is located at the lower end of the vertical screen 42' and is sufficiently sized for reflecting the fuel bed 26 to produce the simulated effect. At the same time, the reflecting region 204 is not overly sized so as to reflect unwanted images such as the floor covering located immediately in front of the fireplace. For this reason, the vertical screen 42' includes the matte region 200 at its middle and upper end. The matte region 200 has a matte finish that does not reflect images while still permitting visibility of the simulated flame image through the vertical screen 42'. The transition regions 202 comprises a gradual transition between the non-reflective matte region 200 and the reflecting region 204.

Figure 12:
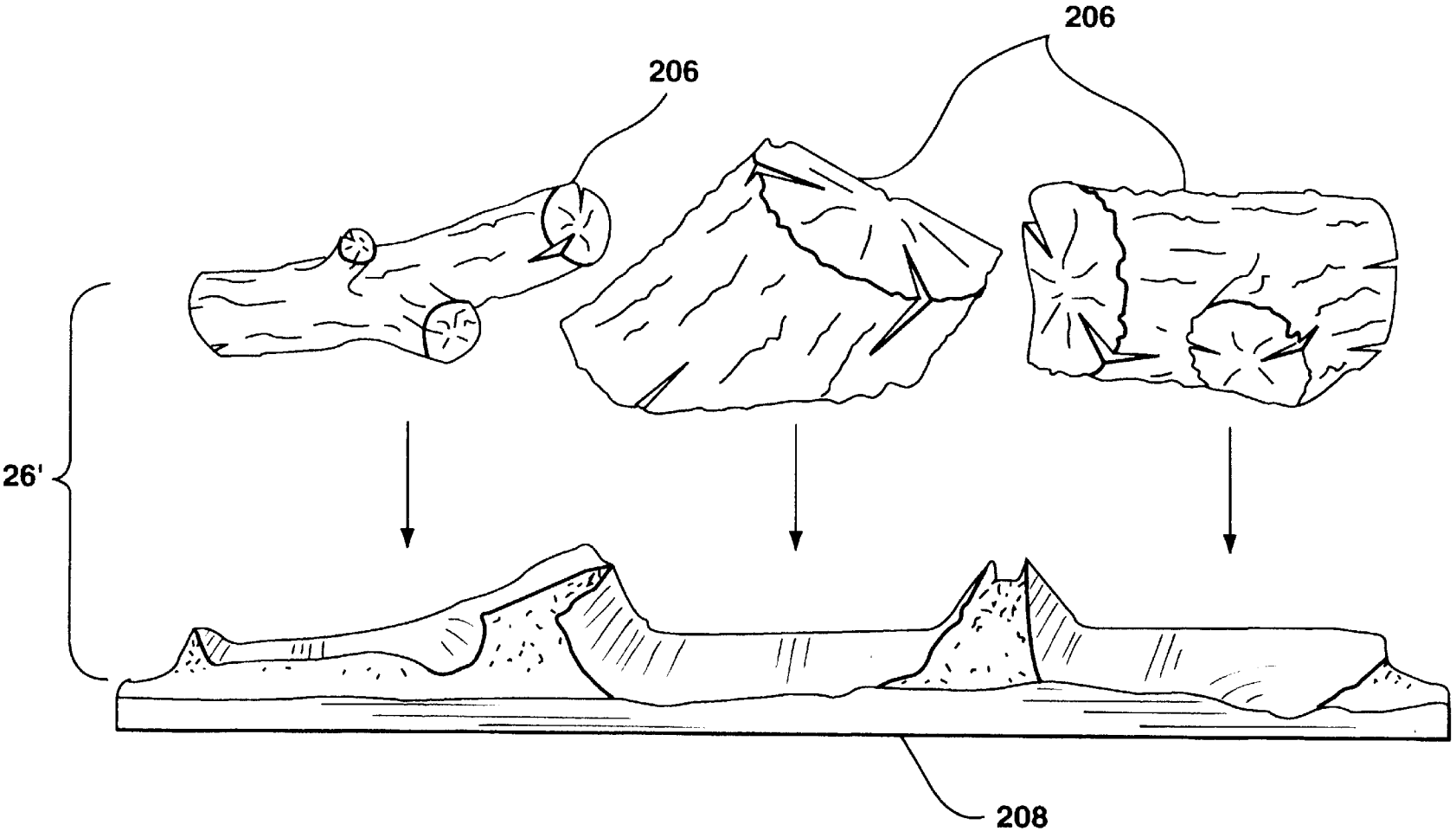
FIG. 12 is an exploded detail view of a second embodiment of the fuel bed.

Referring to FIG. 12, an improved fuel bed 26' is shown. The fuel bed 26' includes a first portion 206 cmposed of a ceramic material and formed and colored to simulate logs. The bed 26' also includes a second portion 208 composed of a plastic material and formed and colored to simulate an ember bed. The ember bed 208 is preferably translucent to permit the passage of light from the light source 30 or fuel bed light assembly 100 as described earlier. It has been found that a more accurate simulation of logs 206 can be accomplished using ceramic materials and flexible molds. The ember bed 208 can still be formed realistically from plastic using a vacuum forming method. The bed is formed to receive the ceramic logs 206. The ceramic logs 206 are then glued to the ember bed 208 to form the fuel bed.

Figure 13:
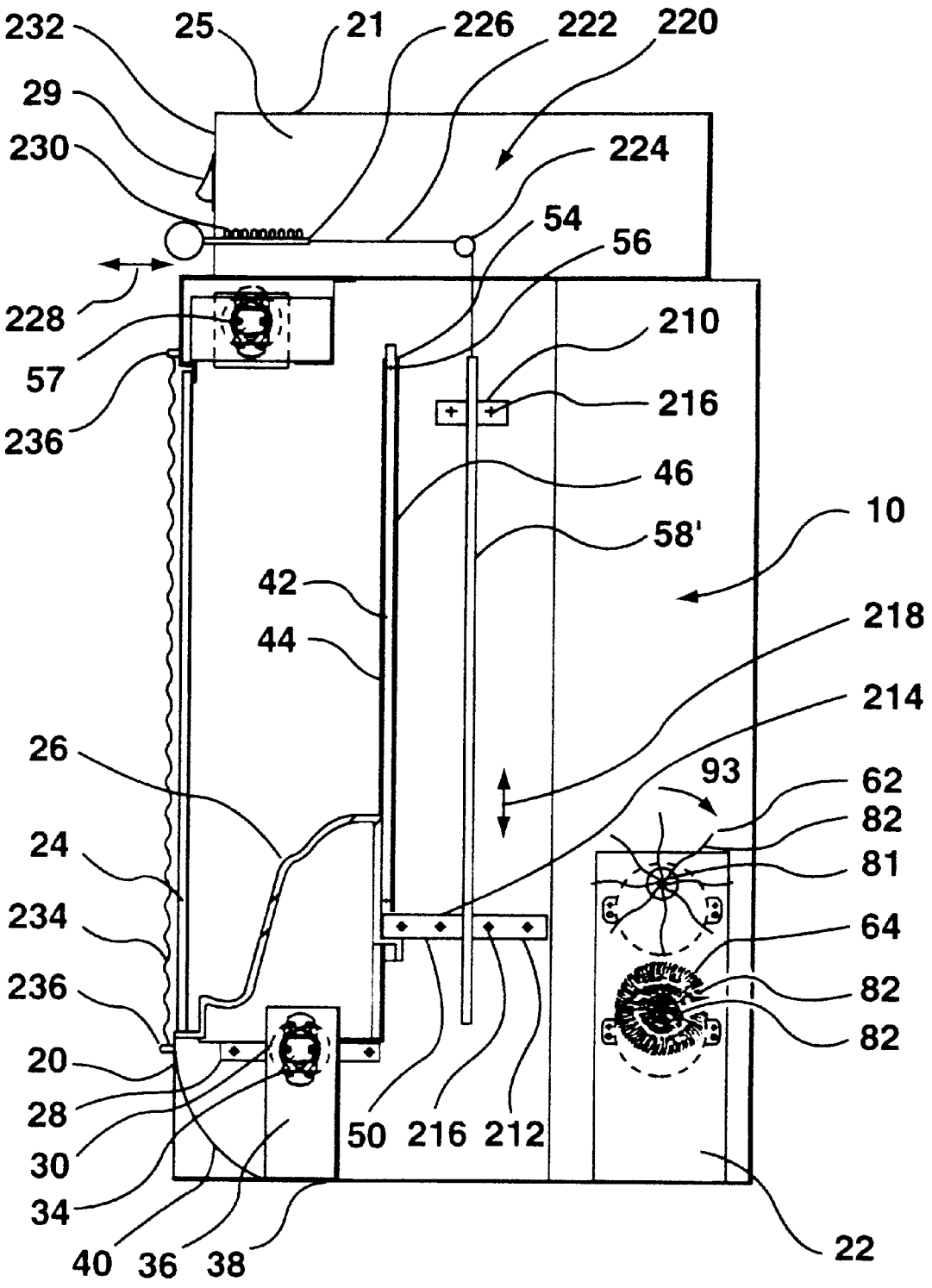
FIG. 13 is a side view of a third embodiment of the flame simulating assembly showing an alternative flame effect element.
Figure 14:
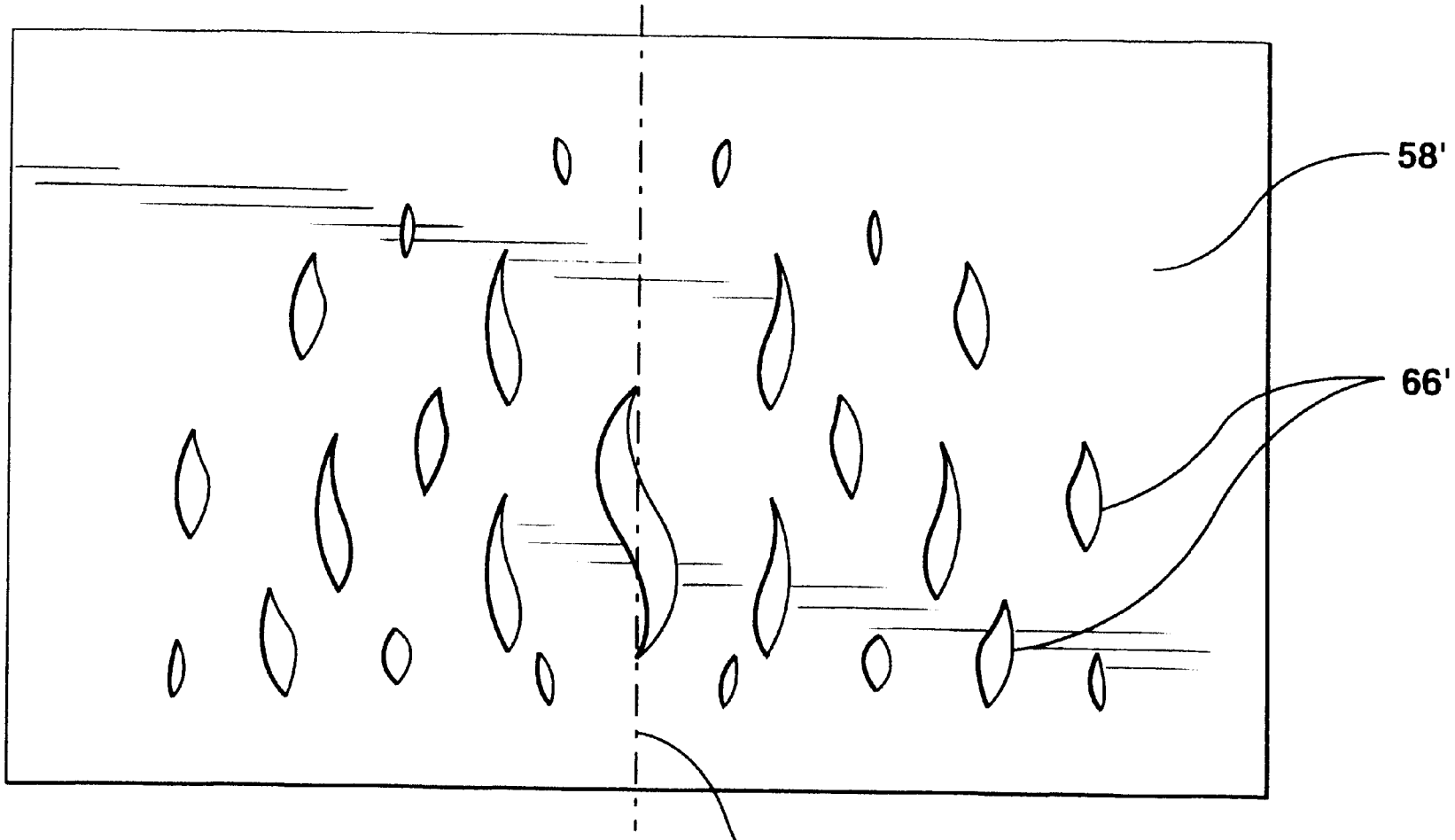
FIG. 14 is a front view of the flame effect element for the assembly of FIG. 13.

Referring to FIGS. 13 and 14, a third embodiment of the flame simulating assembly 10 is depicted. For convenience, the same reference numbers have been used to refer to the same elements. The third embodiment does not include the blower 60 or the light-weight flame effect element 58 which was adapted to billow in the airflow of the blower. Instead, an improved flame effect element 58' is positioned behind and substantially across the full width of the screen 42. The improved flame effect element 58' is similar in appearance to the flame effect element 58 depicted in FIG. 5. However, the improved flame effect element 58' is positioned preferably in a generally vertical plane approximately three inches behind the screen 42 (and about ½ inch from the flicker elements 62, 64). The element 58' is preferably formed of a more rigid material (e.g. plastic or thin steel) so that it will remain generally stationary in its vertical position. However, a light-weight material such as polyester may be used instead with the element 58' being stretched taut into a vertical position. Furthermore, it should be understood that a vertical position for the element 58' is not critical, so long as light passage is possible as described below.

A plurality of slits 66' are cut into the flame effect element 58' to permit passage of light from the light source 30 through the flame effect element 58' to the screen 42. While the improved flame effect element 58' remains relatively stationary, the flame simulation effect is nonetheless observable due to the reflection of light from the flicker elements 62 and 64 as the light passes through the slits 66'.

The improved flame effect element 58' is sandwiched between upper and lower support elements 210 and 212 to support the flame effect element in a generally vertical position. The lower horizontal support member 50 acts as one of the lower support elements. In addition, lower horizontal support member 50 acts as a horizontal opaque screen 214 to block light from passing below the screen 42 and flame effect element 58'. In this manner, substantially all of the light reaching the screen 42 has been reflected by flicker elements 62 and 64 and passes through slits 66' in the flame effect element 58'. The upper and lower support elements 210 and 212 are fastened to the side walls 23 of the housing 14 with fasteners 216.

Alternatively, the element 58' could be formed with a horizontal living hinge at its lower end. The portion below the living hinge could be connected to the screen 42 and act as the horizontal opaque screen 214. The portion above the screen should be supported at least at its upper end by the upper support element 210. The living hinge allows the element 58' to be moved up or down as described below.

The flame effect element 58' is preferably movable upwardly or downwardly relative to the screen 42 in the direction of arrows 218. This is accomplished by a height adjustment mechanism shown generally at 220. The mechanism 220 includes a wire 222 connected to the top of the flame effect element 58'. The wire 222 extends over a pin 224 and connects at its other end to the end of a height adjusting knob 226. The height adjusting knob 226 protrudes from the front of the control unit 21 and is capable of being moved inwardly and outwardly relative to the front face of the control unit 21 in the direction of arrows 228. The height adjusting knob 226 includes a plurality of teeth 230 that engage the front face 232 of the control unit 21 to permit the knob 226 to be secured inwardly or outwardly relative to the control unit 21 in one of a plurality of positions. It has been found that, by raising or lowering the flame effect element 58' by a predetermined amount, the perceived intensity of the simulated flame (both the brightness and size of the flame) effect can be increased or decreased. It is believed that this change in intensity is due to the different sized slits 66' defined in the flame effect element 58' being more or less visible to an observer positioned in front of the fireplace 12. It will be appreciated that alternative height adjustment mechanisms may be chosen. For instance, the knob 226, may be connected to the flame effect element 58' by a cam arrangement for mechanically moving the element 58' up or down.

The embodiment depicted in FIG. 13 further includes a simulated fire screen 234 covering the front face 232 of the transparent front panel 24. The simulated fire screen 234 is preferably a woven mesh such as is known for blocking sparks for conventional fireplaces. The woven mesh fire screen 234 is supported at its top and bottom ends by pins 236 protruding from the front wall 20 of the housing 14. Alternatively, the simulated fire screen 234 can be defined directly on the transparent front panel 24 using a silk screen process or the like. It has been found that the simulated fire screen 234 reduces any glare or reflection that otherwise might be visible on the transparent front panel 24.

Figure 15:
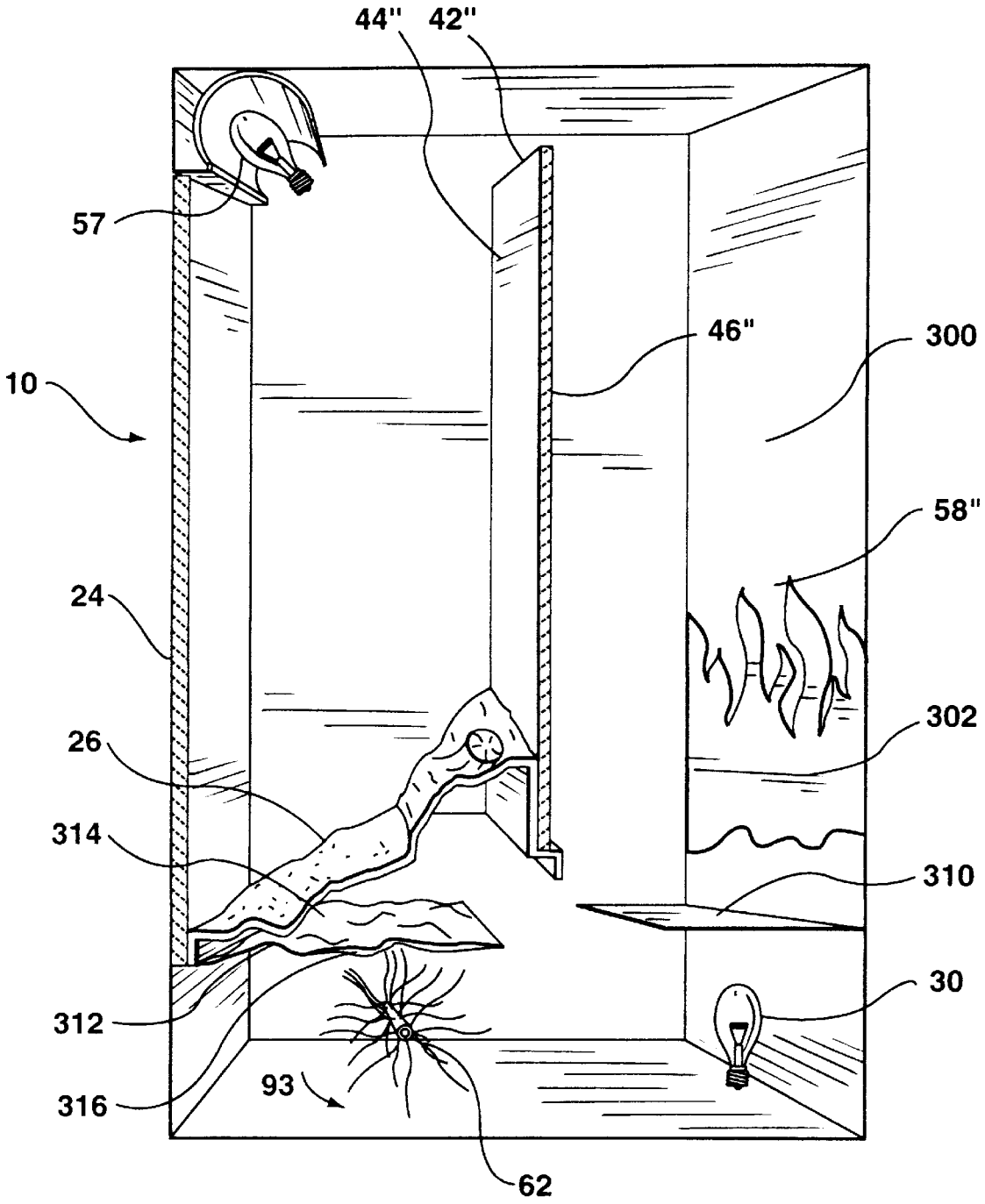
FIG. 15 is a perspective side view of a fourth embodiment of the flame simulating assembly, showing an alternative flame effect element and an alternative vertical screen.

Referring to FIG. 15, a further improved vertical screen 42" is shown. The screen 42" is generally transparent and has a partially reflecting surface 44" and a diffusing region 46" through its thickness. The screen 42" is fabricated from a generally transparent but partially translucent material preferably having a slightly clouded or milky appearance through its thickness, such that light passing through the screen 42" is partially transmitted and partially diffused. A satisfactory material is a polystyrene which is given a slightly milky appearance by the addition of an amount of a powdered white pigment, such as titanium dioxide. The particle size of the pigment material is preferably microscopic so that a uniformly clouded or milky appearance is imparted to the diffusing region 46". The amount of diffusion achieved by diffusing region 46" can be controlled by the amount of pigment added to the plastic composition of diffusing region 46". The amount of diffusion achieved by diffusing member 46" should be such that a three-dimensional flame appears through the thickness of diffusing member 46", when viewed through partially reflecting member 44".

By diffusing the projected light of the simulated flame gradually through the thickness of the screen 42", the improved screen 42" gives an apparent thickness to the simulated flame, creating the illusion of a three dimensional flame. Furthermore, the improved screen 42" does not rely on a sandblasted or etched surface for its diffusing effect and therefore simplifies construction of assembly 10.

Figure 16:
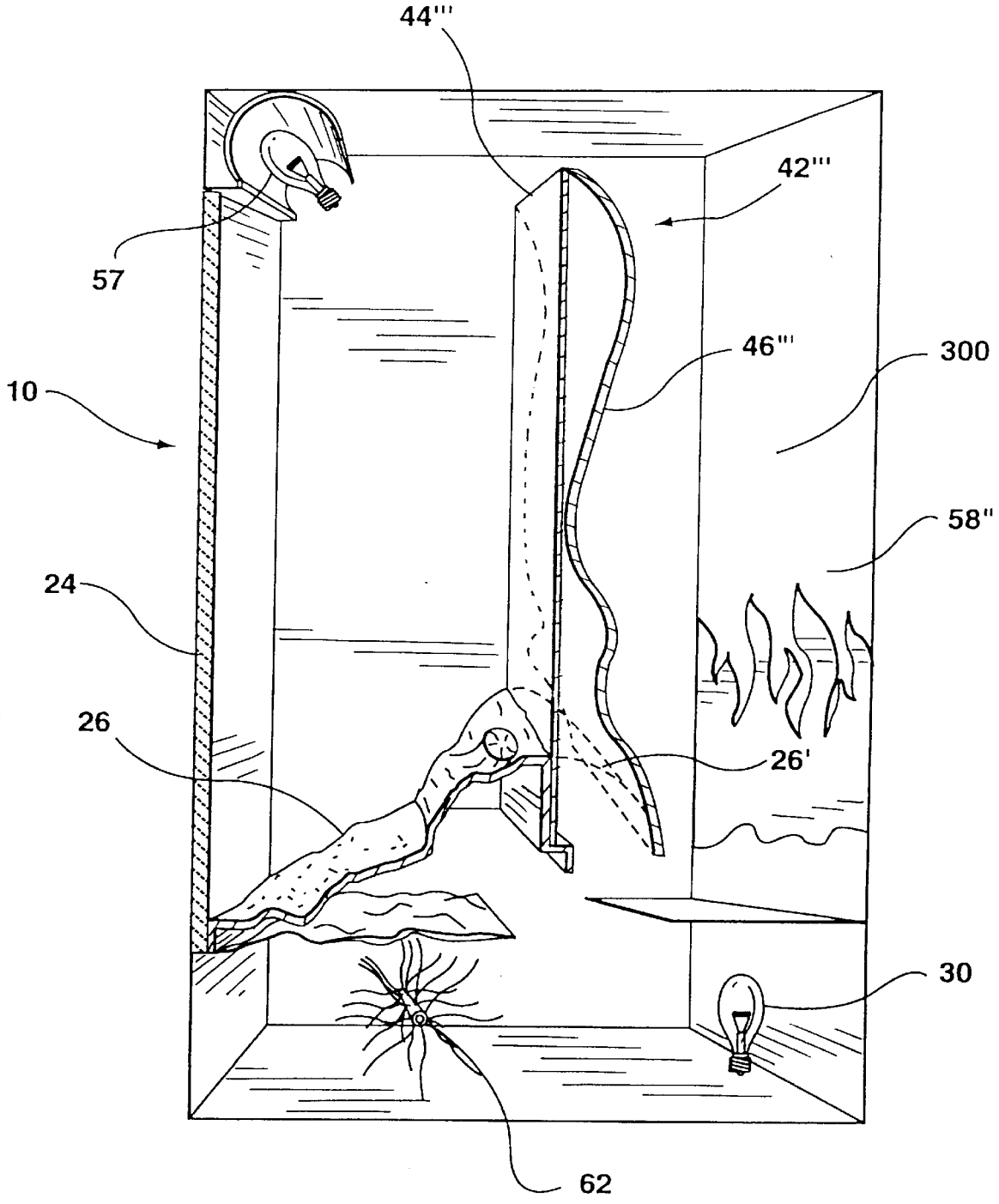
FIG. 16 is a perspective side view of an alternative vertical screen assembly for the assembly of FIG. 1 or FIG. 15.

Referring to FIG. 16, a further improved vertical screen assembly 42'" is shown. The screen 42'" is composed of a reflecting member 44'" and a diffusing member 46'". The reflecting member 44'" is fabricated from a partially transparent, partially reflective material, such as semi-silvered glass. Diffusing member 46'" is fabricated from a translucent material that partially transmits and partially diffuses light passing through the diffusing member 46'". Diffusing member 46'" may be made from a transparent material similar to that used in screen 4, and given an etched or sand blasted diffusing surface, similar to diffusing surface 46. Alternatively, translucent materials, such as white polystyrene and polypropylene, have also been found to be suitable for diffusing member 46'". Where a translucent material is used, the thickness of a particular material used for diffusing member 46'" is chosen to allow diffusing member to be self-supporting and yet remain translucent enough that a flame effect is observable thereon through partially reflecting member 44'". Diffusing member 46'" does not necessarily embody the elements of diffusing screen 46", described above.

Diffusing member 46'" is not planar but rather curved along its length and width, the direction and amount of the curvature varying both vertically and horizontally along diffusing member 46'". Diffusing member 46'" may be conveniently formed by vacuum-forming a sheet of plastic to the desired shape. The curvature, in the vertical direction, of the lower portion of diffusing member 46'" preferably follows the apparent location of fuel bed 26 in reflecting member 44'" (indicated at 26') to give the appearance that the simulated flames projected thereon are emanating from behind the reflection 26' of fuel bed 26. For example, if fuel bed 26 included simulated wood logs, the simulated flames projected on diffusing member 46'" would appear to be emanating from behind the reflection 26' of the simulated logs in fuel bed 26. The curvature of the lower portion diffusing member 46'", in the horizontal direction along fuel bed 26, preferably tracks the particular angle at which a simulated log appears to lay in fuel bed 26 and follows the apparent location of the log in reflecting member 44'" (indicated at 26'). At a horizontal position on fuel bed 26 where no simulated log appears, diffusing member 46'" is locally curved to be adjacent reflecting member 44'" to give the appearance that the simulated flames projected thereon are emanating from the embers between the simulated logs of fuel bed 26.

As diffusing member 46'" rises vertically away from fuel bed 26, it preferably then curves generally closer to reflecting member 44'" to create the illusion that simulated flames projected thereon are licking over the logs of fuel bed 26. The curvature of the upper portion of diffusing member 46'" may be appropriately chosen to further simulate the turbulent and random pattern of a real flame.

The vertical screen assembly 42'" adds an additional three-dimensional effect to the simulated flame. When viewed through partially reflecting member 44'", the simulated flame appears to emanate from behind the simulated logs of fuel bed 26 and subsequently travel a three-dimensional path as it appears to rise from fuel bed 26, which more accurately simulates the appearance of a real wood fire.

Figure 17:
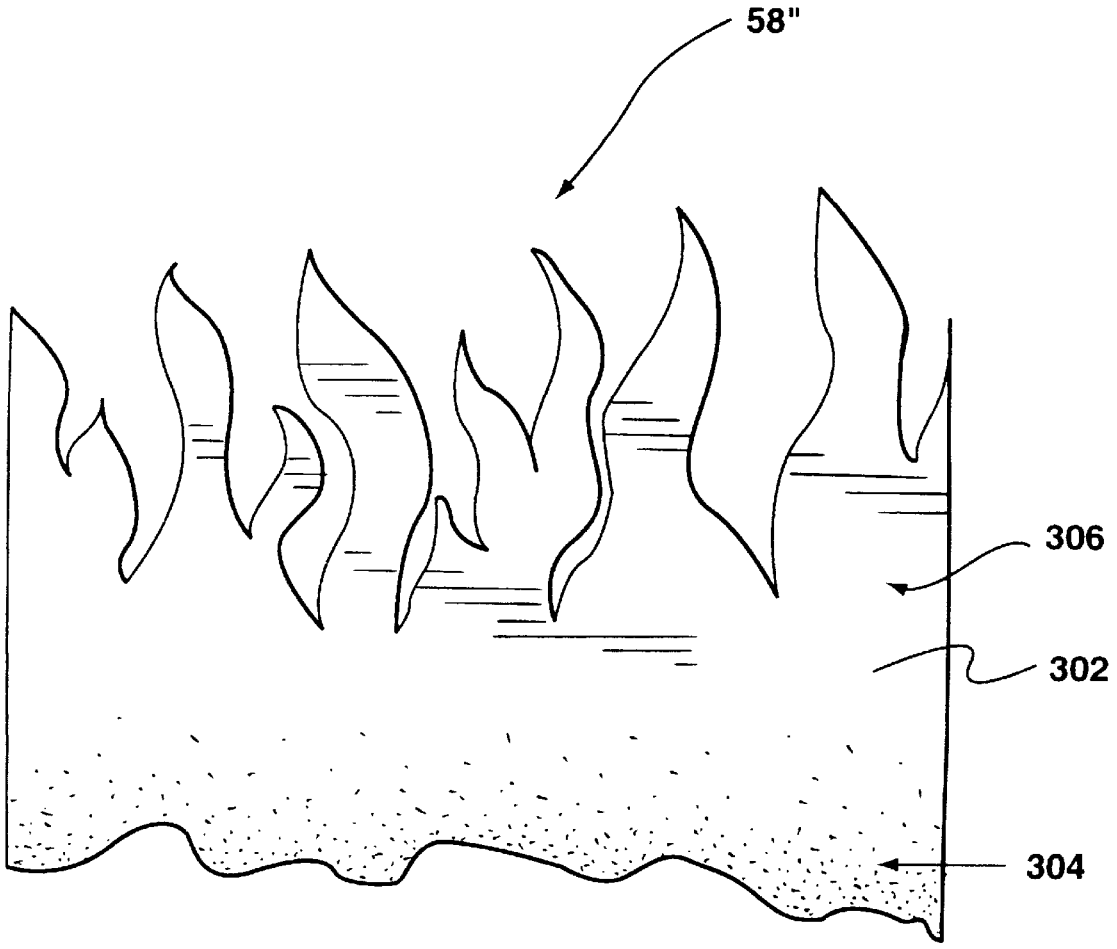
FIG. 17 is a front view of the flame effect element for the assembly of FIG. 15.

Referring to FIGS. 15 and 17, a fourth embodiment of flame simulating assembly 10 is depicted. For convenience the same reference numbers have been used to refer to the same elements. The fourth embodiment does not include a blower 60 or a light-weight flame effect element 58 adapted to billow in the airflow of blower 60. Instead, an improved and simpler flame effect element 58" is positioned behind and substantially across the full width of the screen 42" (a screen 42, as shown in FIG. 2, may equally be used), and in front of back wall 300. The improved flame effect element 58" has a reflective surface 302 and generally has a flame-like profile, as depicted in FIG. 17. Back wall 300 has a non-reflective surface. In a preferred embodiment, the element 58" is a reflective decal applied to the surface of back wall 300. To simulate the colors of a natural flame, flame effect element 58" is preferably colored with a bluish or greenish base portion 304 and a silver body 306. The transition between the blue portion 304 and the silver 306 is made gradually as the intensity of the blue color in portion 304 is faded into silver portion 306.

Referring again to FIG. 15, a single flicker element 62, rotating in direction 93, is positioned below the fuel bed 26 and generally in front of flame effect element 58". Adjacent and behind the flicker element 62 is positioned the light source 30. A light block 310 is provided to prevent light from light source 30 from reaching the flame effect element 58" directly. Hence, substantially only light reflected from flicker element 62 reached flame effect element 58" and is subsequently reflected to, and transmitted through screen 42". The apparent intensity of the simulated fire is proportionate to the speed at which flicker element 62 turns. A variable speed control (not shown) for flicker element 62 may be provided to allow the user to alter the apparent intensity of the simulated fire.

The introduction of a fixed flame element 58" removes previous problems of silk element 58 clinging to screen 42". Further, the improved design removes the need for blower 60 and lower flicker 64, making assembly 10 simpler to manufacture and maintain. Furthermore, by repositioning the flicker element 62 beneath fuel bed 26, a more compact flame simulating assembly 10 may be achieved or, alternatively, fuel bed 26 may be moved further back, away from front panel 24, giving assembly 10 the look of a deeper, more realistic fireplace. Also, the repositioning of flicker element 62 further simplifies the invention by removing the need for a light source 30 with flickering intensity.

The embodiment depicted in FIG. 15 may further include a transparent light randomizing panel 312, positioned between fuel bed 26 and flicker element 62. The panel 312 is preferably made of glass or optical grade plastic and has non-planar surfaces 314 and 316. The surfaces 314, 316 each have convex and concave regions which smoothly and contiguously blend into one another, resulting in a panel 312 having a varied thickness. In use, panel 312 acts as a complex lens, with regions of varied focal length, to light reflecting towards fuel bed 26 from flicker element 62, which is rotating in direction 93. The effect of the complex lens-like characteristics of panel 312 is to intermittently reverse the direction of the reflected light from flicker element 62 as it crosses fuel bed 26. The result is that the simulated coals of fuel bed 26 appear to flicker in a random direction, and not only in the direction of rotation of flicker element 62.

Figure 18:
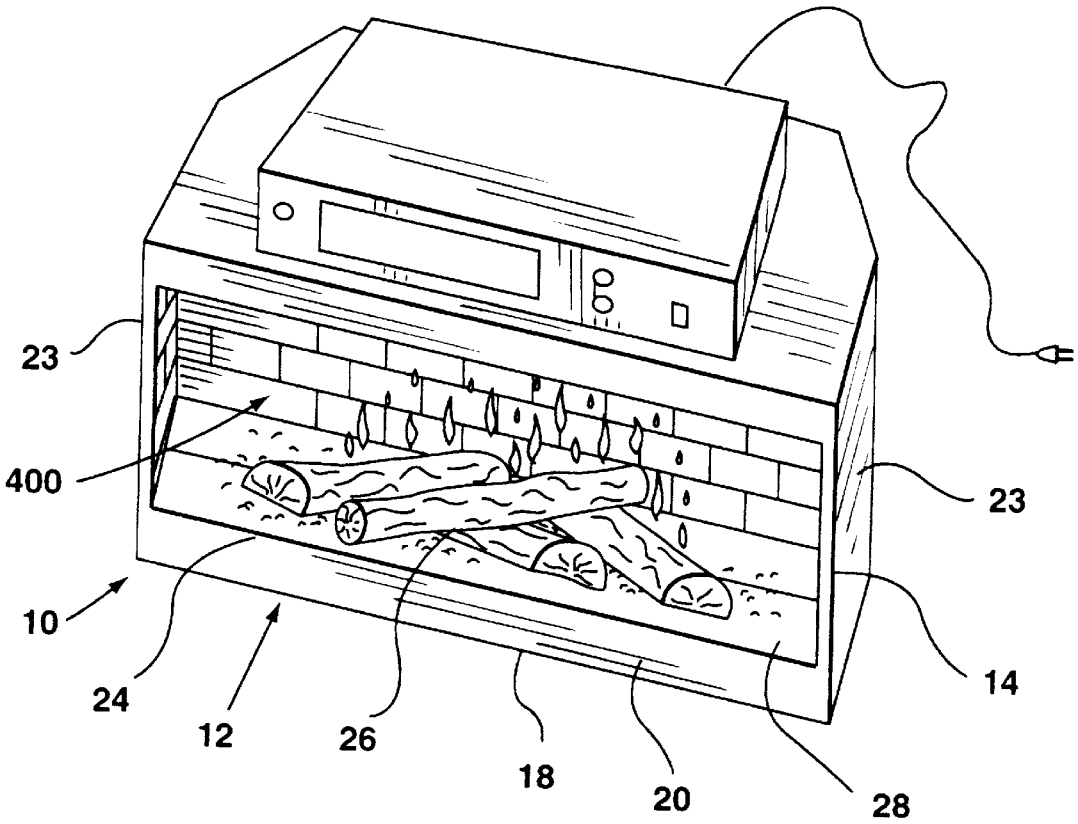
FIG. 18 is a front perspective view of an electric fireplace incorporating a fire wall simulating assembly.
Figure 19:
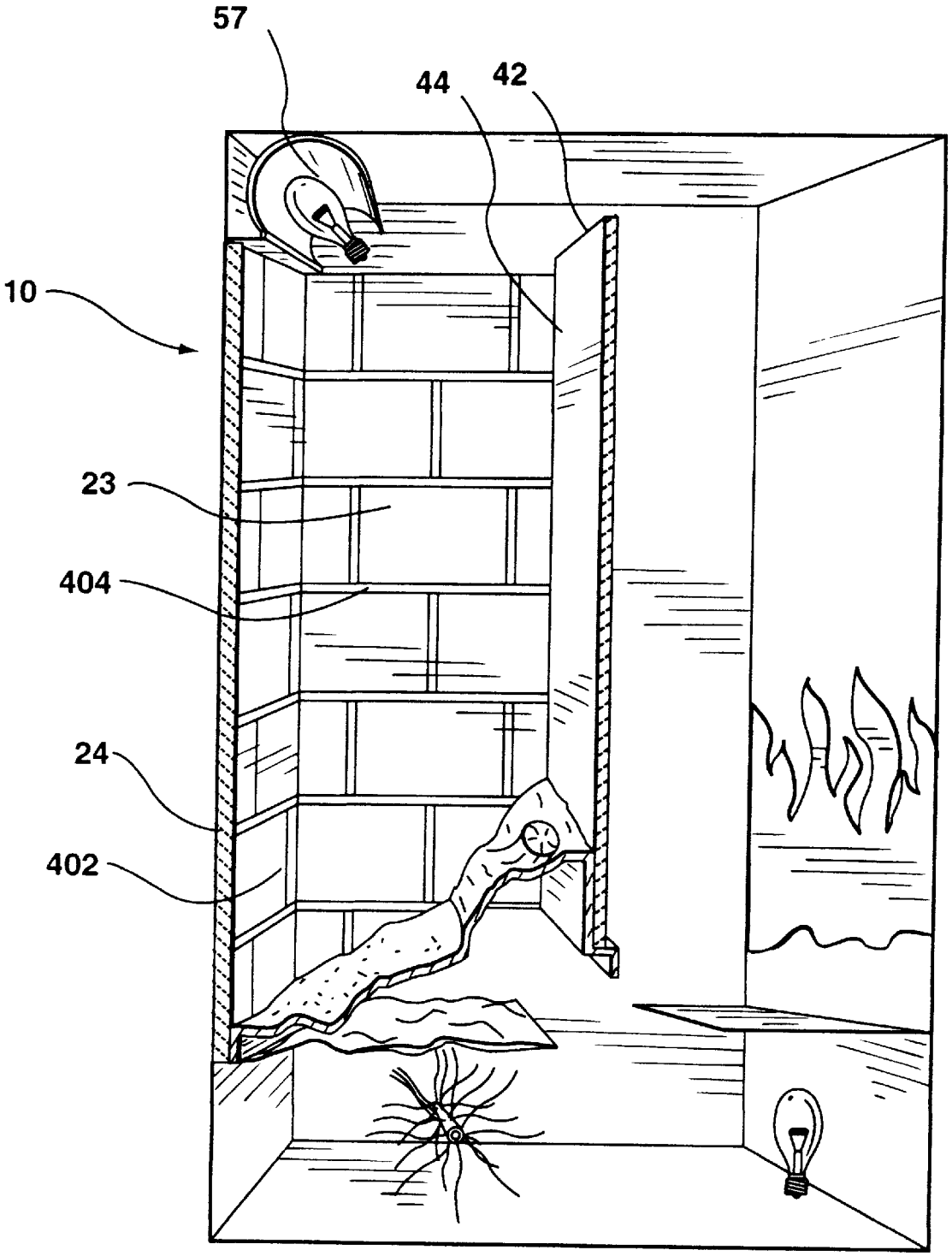
FIG. 19 is a perspective side view of the fireplace of FIG. 18.
Figure 20:
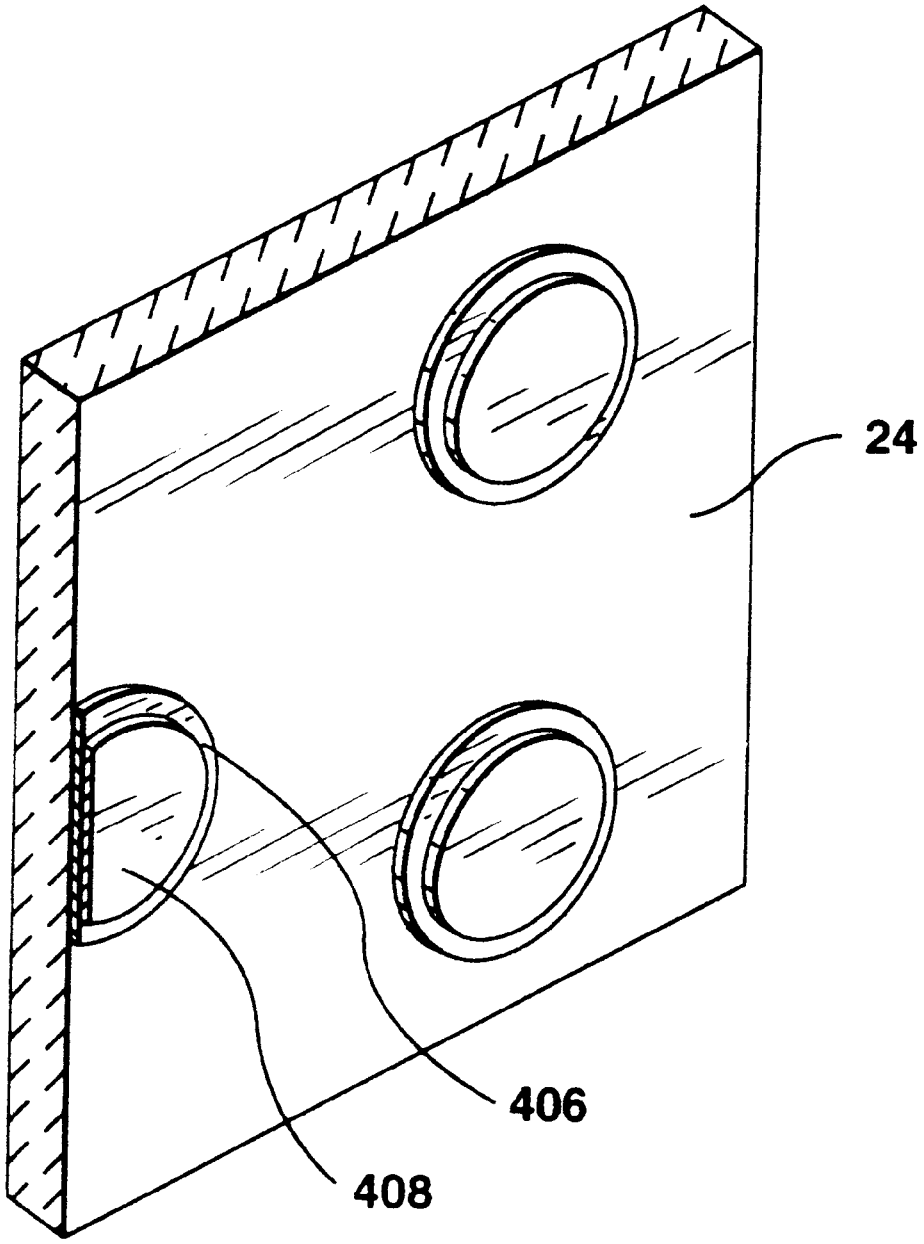
FIG. 20 is an enlarged perspective view of the inner surface of the front wall of the assembly of FIG. 18.

Referring to FIGS. 18, 19 and 20, a further improved flame simulating assembly 10 with a simulated brick or rock fire wall 400 is depicted. For convenience, the same reference numbers have been used as previously to refer to the same elements. Referring to FIG. 19, simulated fire wall patterns 402, 404 are applied to the inner surfaces of transparent front panel 24 and each of side walls 23, respectively. Fire wall pattern 404 is applied by painting, or similar method, the pattern 404 on the inner surface of each side wall 23. The pattern 402, as will be explained further below, is applied to the inner surface of transparent front panel 24 preferably by applying, using a silk-screening method, a series of small colored dots in a random pattern. The dots are applied in such a manner that an observer positioned in front of transparent front panel 24 will not readily notice the dots applied to the inner surface of the panel 24 but will, however, notice the reflection of the dots in the reflecting surface 44. The effect gives the illusion of a fire wall appearing behind the image of the simulated flames emanating from the fuel bed 26. A light source 57 is provided beneath top wall 16 to light the pattern 402 to strengthen its reflection in surface 44. To create a more realistic lighting of patterns 402, 404, light source 57 may be made to flicker randomly to simulate lighting on the simulated fire wall 400 by a real flame. The flicker in light source 57 could be achieved by integrated circuit control (not shown) of the electricity supplied to light source 57.

Referring to FIG. 20, a preferred method of applying pattern 402 to the interior surface of front panel 24 is shown. First, a random pattern of small dots 406 is applied to the inner surface of front panel 24. Although random, the pattern of dots 406 has a constant dot density per square inch across the entire inner surface of front panel 24. Dots 406 are preferably all the same size. The dot density and a size of dots 406 are preferably chosen such that the presence of the dots 406 is not readily noticeable to an observer and the only effect imparted to the glass by the presence of dots 406 is a smoked or tinted appearance to transparent front panel 24. This effect is best achieved if the dots 406 are black in color. Preferably the dots 406 are applied to the inner surface of panel 24 using a silk screening process. Once the dots 406 have been applied, a set of colored dots 408, of slightly smaller diameter than dots 406, is applied on top of dots 406. Dots 408 are of slightly smaller diameter than, and located concentrically on, dots 406 to ensure that an observer positioned in front of assembly 10 will not notice the presence of dots 408 on the inner surface of transparent panel 24. The dots 408 are also preferably applied using a silk screening process. Dots 408 preferably appear in two colors, the two colors being the color of the simulated brick and the color of the simulated mortar between the simulated bricks. The color of a particular dot 408 is preferably chosen such that an overall brick and mortar pattern is formed on the inner surface of front panel 24.

In use, the presence of the dots 406 and 408 on the inner surface of transparent front panel 24 is not readily noticed by an observer positioned in front of flame simulating assembly 10, however, the reflection of the colored dots 406 in reflecting surface 44 is readily apparent to the observer. The simulated fire wall 400 appears to the observer to be behind fuel bed 26 at twice the distance of front panel 24 to the back of fuel bed 26. By locating dots 406 randomly across the inner surface of front panel 24, a visible interference pattern is avoided. This interference pattern would appear if the dots were regularly located on the inner surface of front panel 24, the interference pattern being caused between the presence of dots 406, 408 on the inner surface of panel 24 and the reflection of dots 406, 408 on reflecting surface 44. Dots 406 are applied with a constant dot density per square inch to ensure that the smoked or tinted appearance which dots 406 impart to front panel 24 is constant across front panel 24. The colors chosen for pattern 402 are also the colors used for pattern 404 on side walls 23. The patterns 402 and 404 are positioned on the inner surface of front panel 24 and side walls 23, respectively, such that the apparent brick and mortar features of the two patterns intersect and mate in a realistic fashion.

It will be apparent that the simulated fire wall pattern 402 can also be achieved using alternate means. For example, a CLEAR FOCUS™ one-way vision display panel (not shown), as is described in U.S. Pat. No. 5,525,177, may be used. Simulated fire wall pattern 402 can be applied to the display surface of a CLEAR FOCUS™ panel which is, in turn, applied to the inner surface of front panel 24, such that an observer positioned in front of flame simulating assembly 10 cannot see pattern 402 directly but can view the reflection of pattern 402 in reflecting surface 44. In another embodiment, the transparent front panel 24 is replaced by a mesh front fire screen 24 (not shown), and the simulated fire wall pattern 402 is applied, with paint or similar means, to the inner surface of fire screen 24. If care is used to ensure that the pattern 402 is applied only to the interior surface of fire screen 24, the pattern 402 will not be directly visible to an observer standing in front of flame simulating assembly 10. The observer will, however, be able to view the reflection of pattern 402 on reflecting surface 44.

It is readily apparent that the apparatus to produce simulated fire wall 400 could be used successfully with any fireplace having a front panel 24 and reflecting surface 44. In particular, it will be apparent that the inclusion of a simulated fire wall 400 would greatly enhance the appearance of a natural gas or propane fireplace. By using the disclosed apparatus to create a simulated fire wall 400, the depth of a fireplace may be decreased as a space-saving measure, however, an observer will not notice that the depth of the fireplace has been decreased.

Figure 21:
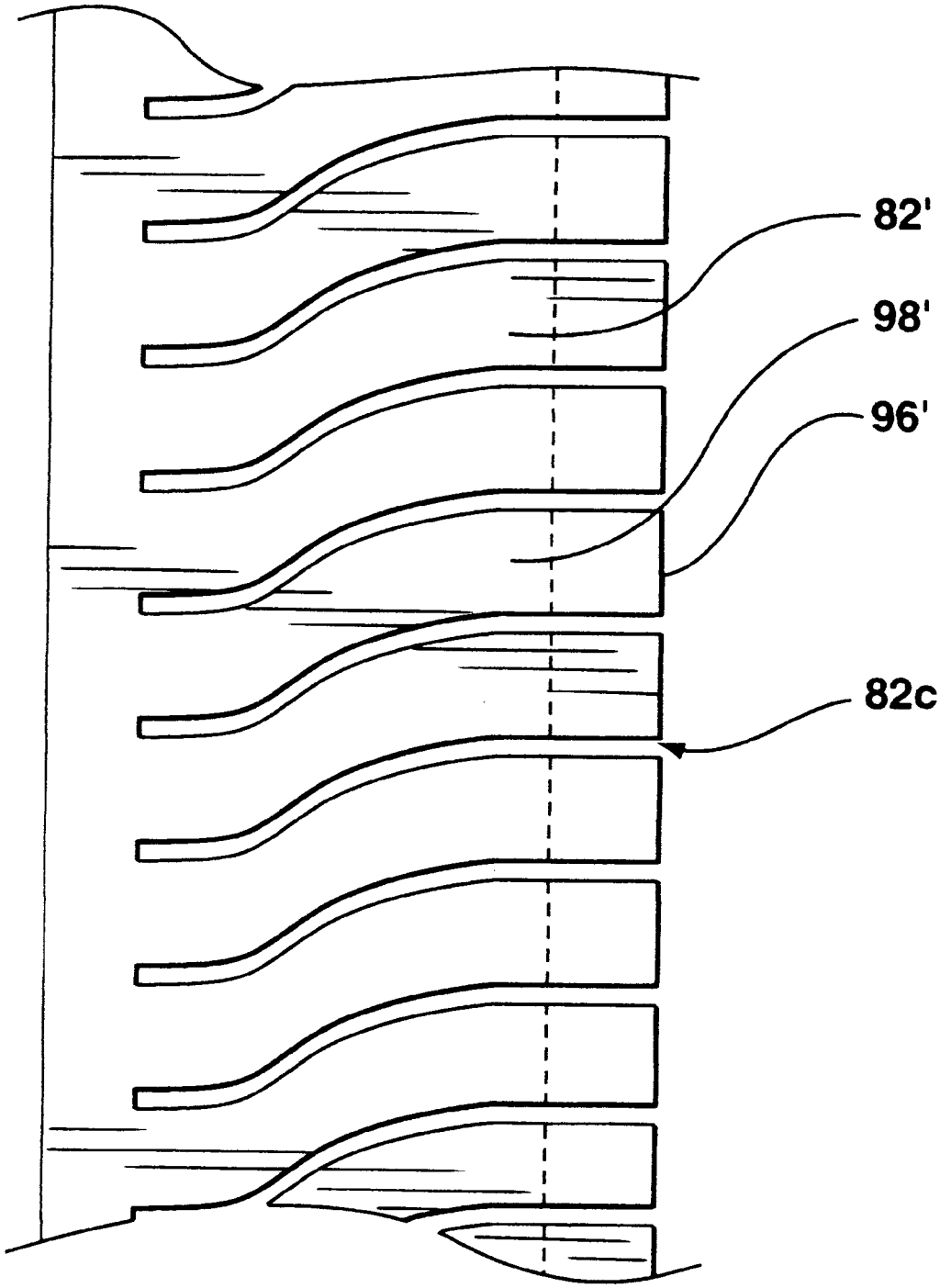
FIG. 21 is a partial plan view of a length of material defining a plurality of radial strips for an alternative embodiment of the upper flicker element of FIG. 1 or FIG. 15.

Referring to FIG. 21, improved strips 82' for the upper flicker element 62 are shown. Since the sharp, straight lines of previous flicker element 62 gave sharp, straight reflections of light, which reduced the realism of the flame simulation, each improved strip 82' is given a series of curvilinear cuts 82*c*. The result is an improved upper flicker element 62 which reflects non-rectilinear patterns of light that are subsequently transmitted through the flame effect element 58. The non-linear nature of the reflected light patterns improves the realism of the flicker in the simulated flame by causing the flickering patterns of reflected light to appear more random and therefore more natural.

It is to be understood that what has been described is a preferred embodiment to the invention. The invention nonetheless is susceptible to certain changes and alternative embodiments fully comprehended by the spirit of the invention as described above, and the scope of the claims set out below.

We claim:

1. A flame simulating assembly for providing an image of flames transmitted in a fluctuating light, comprising:

(a) a simulated fuel bed;

(b) a light source;

(c) a screen having a partially reflective front surface disposed behind the simulated fuel bed for reflecting and transmitting light, and a diffusing member disposed behind the partially reflective front surface for diffusing and transmitting light, the diffusing member having a non-planar back surface; and (d) a flicker element for creating the fluctuating light, wherein the non-planar back surface is sufficiently spaced from the partially reflective front surface that the fluctuating light transmitted through the diffusing member is attenuated and a three-dimensional image of flames appears through the screen.

2. The flame simulating assembly as claimed in claim 1 wherein the non-planar back surface includes a first curvature in a vertical direction and a second curvature in a horizontal direction.

3. A flame simulating assembly for providing an image of flames transmitted in a fluctuating light, comprising:

(a) a simulated fuel bed;

(b) a light source;

(c) a screen having a partially reflective front element disposed behind the simulated fuel bed for reflecting and transmitting light, and a diffusing element disposed behind the partially reflective front element for diffusing and transmitting light, the diffusing element being non-planar; and (d) a flicker element for creating the fluctuating light, the diffusing element being sufficiently spaced from the partially reflective front element that the fluctuating light transmitted through the diffusing element is attenuated and a three-dimensional image of flames appears through the screen.

4. The flame simulating assembly as claimed in claim 1 wherein the non-planar diffusing element includes a first curvature in a vertical direction and a second curvature in a horizontal direction.

5. The flame simulating assembly as claimed in claim 3 wherein the diffusing element has a non-planar back surface.

6. The flame simulating assembly as claimed in claim 3 wherein the diffusing element has a non-planar inner surface disposed facing the front element.

7. A flame simulating assembly for providing an image of flames transmitted in a fluctuating light, comprising:

(a) a simulated fuel bed;

(b) a light source;

(c) a screen having a partially reflective front surface disposed behind the simulated fuel bed for reflecting and transmitting light, and a diffusing member disposed behind the partially reflective front surface for diffusing and transmitting light, the diffusing member having a non-planar back surface;

(d) a flicker element for creating the fluctuating light; and (e) a flame effect element positioned in a path of the fluctuating light between the light source and the diffusing member, to configure the fluctuating light, wherein the non-planar back surface is sufficiently spaced from the partially reflective front surface that the fluctuating light transmitted through the diffusing member is attenuated and a three-dimensional image of flames appears through the screen.

8. The flame simulating assembly as claimed in claim 7 wherein the non-planar back surface includes a first curvature in a vertical direction and a second curvature in a horizontal direction.

9. The flame simulating assembly as claimed in claim 7 wherein the flame effect element is reflective and is positioned on a back wall of the flame simulating assembly disposed behind and spaced from the diffusing member, the back wall being relatively less reflective than the flame effect element, such that the fluctuating light is reflected by the flame effect element to the diffusing member.

10. The flame simulating assembly as claimed in claim 7 wherein the flame effect element has a first part which transmits light and a second part which blocks light.

11. The flame simulating assembly as claimed in claim 10 wherein the flame effect element has apertures defining said first part.

12. A flame simulating assembly for providing an image of flames transmitted in a fluctuating light, comprising:

(a) a simulated fuel bed;

(b) a light source; and (c) a screen having a partially reflective front element disposed behind the simulated fuel bed for reflecting and transmitting light, and a diffusing element disposed behind the partially reflective front element for diffusing and transmitting light, the diffusing element being non-planar;

(d) a flicker element for creating the fluctuating light; and (e) a flame effect element positioned in a path of the fluctuating light between the light source and the diffusing element, to configure the fluctuating light, the diffusing element being sufficiently spaced from the partially reflective front element that the fluctuating light transmitted through the diffusing element is attenuated and a three-dimensional image of flames appears through the screen.

13. The flame simulating assembly as claimed in claim 12 wherein the non-planar diffusing element includes a first curvature in a vertical direction and a second curvature in a horizontal direction.

14. The flame simulating assembly as claimed in claim 13 wherein the diffusing element is composed of polystyrene.

15. The flame simulating assembly as claimed in claim 14 wherein the polystyrene is pigmented with white powder.

16. The flame simulating assembly as claimed in claim 15 wherein the white powder is titanium dioxide.

17. The flame simulating assembly as claimed in claim 12 wherein the diffusing element has a non-planar back surface.

18. The flame simulating assembly as claimed in claim 12 wherein the diffusing element has a non-planar inner surface disposed facing the front element.

19. The flame simulating assembly as claimed in claim 12 wherein the flame effect element is reflective and is positioned on a back wall of the flame simulating assembly disposed behind and spaced from the diffusing element, the back wall being relatively less reflective than the flame effect element, such that the fluctuating light is reflected by the flame effect element to the diffusing element.

20. The flame simulating assembly as claimed in claim 12 wherein the flame effect element has a first part which transmits light and a second part which blocks light.

21. The flame simulating assembly as claimed in claim 20 wherein the flame effect element has apertures defining said first part.

* * * * *

UNITED STATES PATENT AND TRADEMARK OFFICE

CERTIFICATE OF CORRECTION

PATENT NO. : 6,363,636 B1
DATED : April 2, 2002
INVENTOR(S) : Kristoffer Hess et al.

It is certified that error appears in the above-identified patent and that said Letters Patent is hereby corrected as shown below:

Column 4,
Line 66, replace "5,965,707" with -- 4,965,707 --.

Signed and Sealed this

Fourth Day of May, 2004

JON W. DUDAS
*Acting Director of the United States Patent and Trademark Office*